US008521071B2

(12) United States Patent
Nishimura et al.

(10) Patent No.: US 8,521,071 B2
(45) Date of Patent: Aug. 27, 2013

(54) DEVELOPER BEARING MEMBER, DEVELOPING APPARATUS, AND IMAGE FORMING APPARATUS

(75) Inventors: Katsuhiko Nishimura, Yokohama (JP); Yukihide Ushio, Mishima (JP); Masahiro Okuda, Sagamihara (JP); Toshihiko Sugimoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 110 days.

(21) Appl. No.: 12/958,351

(22) Filed: Dec. 1, 2010

(65) Prior Publication Data

US 2011/0135346 A1 Jun. 9, 2011

(30) Foreign Application Priority Data

Dec. 4, 2009 (JP) ..... 2009-276832

(51) Int. Cl.
*G03G 15/08* (2006.01)

(52) U.S. Cl.
USPC ..... 399/286

(58) Field of Classification Search
USPC ..... 399/286, 276, 281
See application file for complete search history.

(56) References Cited

U.S. PATENT DOCUMENTS

| | | | | |
|---|---|---|---|---|
| 5,502,552 | A | 3/1996 | Iwata | |
| 2001/0023225 | A1 * | 9/2001 | Litman et al. | 492/56 |
| 2001/0048828 | A1 * | 12/2001 | Ishii et al. | 399/281 |
| 2002/0037184 | A1 * | 3/2002 | Nakamura | 399/286 |
| 2004/0067189 | A1 * | 4/2004 | Sugiura et al. | 423/335 |
| 2006/0240351 | A1 * | 10/2006 | Sugiura et al. | 430/108.11 |
| 2008/0050670 | A1 * | 2/2008 | Ayaki et al. | 430/110.4 |
| 2008/0107455 | A1 * | 5/2008 | Suzuki et al. | 399/286 |
| 2009/0060591 | A1 * | 3/2009 | Kojima et al. | 399/276 |
| 2009/0202263 | A1 * | 8/2009 | Yoshida et al. | 399/49 |
| 2009/0208255 | A1 * | 8/2009 | Yamada et al. | 399/286 |
| 2010/0124440 | A1 * | 5/2010 | Inagaki | 399/220 |

FOREIGN PATENT DOCUMENTS

| | | | |
|---|---|---|---|
| JP | 7-013410 | A | 1/1995 |
| JP | 11-073006 | A | 3/1999 |
| JP | 2003-208012 | A | 7/2003 |
| JP | 2007-127809 | A | 5/2007 |

OTHER PUBLICATIONS

Specification sheet of ASKER Type C hardness testers.*
SYSMEX FPIA-3000 specification sheet.*

* cited by examiner

*Primary Examiner* — David Gray
*Assistant Examiner* — Sevan A Aydin
(74) *Attorney, Agent, or Firm* — Canon U.S.A., Inc., IP Division

(57) ABSTRACT

A developer bearing member includes a base body, a surface layer, and a plurality of concave portions provided on the surface layer, wherein a resistance value of the surface layer is $10^2$ Ω·cm to $10^8$ Ω·cm, the number of the concave portions per unit area is 2250/mm$^2$ to 12254/mm$^2$, a major diameter of an opening of the concave portion is 8 μm to 20 μm, a depth of the concave portion is 2 μm to 5 μm, a dimensional tolerance of the major diameter is 0.5 μm or less, and a dimensional tolerance of the depth is 0.5 μm or less.

20 Claims, 18 Drawing Sheets

DEGREE OF CIRCULARITY = (PERIMETER OF CIRCLE OBTAINED FROM DIAMETER OF AREA-EQUIVALENT CIRCLE)/(PERIMETER OF PARTICLE PROJECTION IMAGE)

DEVELOPER BEARING MEMBER, DEVELOPING APPARATUS, AND IMAGE FORMING APPARATUS

BACKGROUND OF THE INVENTION

1. Field of the Invention

The present invention relates to a developer bearing member for developing an electrostatic latent image formed on an image bearing member with one-component developer, a developing apparatus including the image bearing member, and an image forming apparatus.

2. Description of the Related Art

Various developing apparatuses are known in which one-component developer (hereinafter referred to as "toner") is coated in thin layer on a developer bearing member, a developing bias is applied to the developer bearing member, an electrostatic latent image formed on an image bearing member is developed with the one-component developer using an electrophotographic method or the like, and the electrostatic latent image is made visible.

As the one-component developer, there are a magnetic one-component developer including magnetic particles (hereinafter referred to as "magnetic toner") and a non-magnetic one-component developer including no magnetic particle (hereinafter referred to as "non-magnetic toner"). However, the one-component developer is not limited to a developer including only toner particles, but may be a developer including one or a plurality of auxiliary materials which can improve fluidity of the developer, limit the amount of charge of the toner, clean the surface of the image bearing member, and so forth.

In the developing method using the non-magnetic toner, a particularly clear color copy can be obtained and image fixability is improved, so that various proposals are presented. For example, a general configuration of a conventional developing apparatus using non-magnetic toner will be described. The non-magnetic toner is contained in a developer container, and is coated uniformly in thin layer on a rotating developer bearing member (hereinafter referred to as "developing sleeve") by the developing sleeve and an elastic blade. The distance between the image bearing member and the developing sleeve is 0.02 to 0.3 mm at a developing area and an electrostatic latent image formed on the image bearing member is made visible with the non-magnetic toner at the developing area.

At this time, a pulse bias, an AC bias, or the like is applied to the developing sleeve by a developing bias power supply. In a developing apparatus using a non-magnetic toner, no magnetic particle is included in the toner, so that insulating capacity of the toner is higher than that of a magnetic one-component developer. In particular, when image development is frequently and repeatedly performed, a specific charge amount of toner increases (charge up), the developing sleeve is contaminated, and toner cohesion on the developing sleeve increases.

A developing apparatus using a magnetic toner includes a developing magnet long in the axis direction inside the developing sleeve. The magnetic toner rotates on the developing sleeve, contacts the developing sleeve, and slides on the developing sleeve, so that the magnetic toner can uniformly obtain sufficient electric charge to develop an image from the developing sleeve. However, a non-magnetic one-component toner has few opportunities to obtain electric charge by such rotation, contact, and sliding, so that it is difficult for the non-magnetic one-component toner to obtain sufficient electric charge uniformly. Therefore, a problem may arise in that the developing density is not uniform.

In addition, another problem may arise, which is a phenomenon called sleeve ghost. The sleeve ghost is unevenness of image density due to image history. When printing is performed after a continuous unprinted area (white area), only low density development is performed. On the other hand, when printing is performed after a continuous printed area (black area), high density development is performed. Therefore, unevenness of density occurs between the printing after a continuous white area and the printing after a continuous black area.

Conventionally, a sandblast process and a knurling process are performed on the developing sleeve to improve transportability.

For example, a developing apparatus discussed in Japanese Patent Application Laid-Open No. 7-13410 (Page 4, FIG. 5) includes a developer bearing member on which spirally shaped groove making concavity and convexity is formed to improve density stability.

An image forming apparatus discussed in Japanese Patent Application Laid-Open No. 2003-208012 (Page 5, FIG. 5) uses a developing roller on which the sandblast process with a surface roughness Rz of 1.5 μm to 10 μm is performed. Alternatively, a developing roller on which knurled grooves having a diamond pattern with a depth of 5 μm to 30 μm are engraved is used to obtain a high-quality image.

An image forming apparatus discussed in Japanese Patent Application Laid-Open No. 2007-127809 (Page 4, FIG. 1, and Page 6, FIG. 8) uses a developer bearing member including grooves having a diamond pattern. Specifically, grooves are formed so that a plurality of grooves extending in the direction slanting to the rotation thrust direction at a sharp angle intersect with a plurality of grooves extending in the direction slanting to the direction opposite to the thrust direction at a sharp angle.

A semiconductor roll discussed in Japanese Patent Application Laid-Open No. 11-73006 (Page 3, FIG. 1) and a developing apparatus using the semiconductor roll use a developing roll on which semiconductor grooves of $10^1$ to $10^9$ Ω·cm are formed in the circumferential direction, whereby a developing apparatus that can obtain a high quality image is provided.

However, in the surface processing of the developing roller described above, toner charge amount (toner triboelectrification) cannot be sufficiently sharpened.

Therefore, image quality desired in recent years cannot be satisfied by the prior art.

SUMMARY OF THE INVENTION

According to an aspect of the present invention, the charge distribution of developer can be sharpened to improve the stability of developing density and reduce sleeve ghost.

According to another aspect of the present invention, a developer bearing member for carrying one-component developer for developing a latent image includes a base body, a surface layer provided above the base body, and a plurality of concave portions provided on the surface layer, wherein a resistance value of the surface layer is $10^2$ to $10^8$ Ω·cm, the number of the concave portions per unit area is 2250/mm$^2$ to 12254/mm$^2$, a major diameter of an opening of the concave portion is 8 to 20 μm, the depth of the concave portion is 2 to 5 μm, a dimensional tolerance of the major diameter is 0.5 μm or less, and a dimensional tolerance of the depth is 0.5 μm or less.

According to yet another aspect of the present invention, a developing apparatus for developing a latent image includes a developer bearing member including a base body and a surface layer on a surface of which a plurality of concave portions are provided and configured to carry one-component developer, and a developer regulating member configured to regulate an amount of developer carried on the developer bearing member, wherein a resistance value of the surface layer is $10^2$ Ω·cm to $10^8$ Ω·cm, the number of the concave portions per unit area is 2250/mm$^2$ to 12254/mm$^2$, a major diameter of an opening of the concave portion is 8 μm to 20 μm, the depth of the concave portion is 2 μm to 5 μm, a dimensional tolerance of the major diameter is 0.5 μm or less, and a dimensional tolerance of the depth is 0.5 μm or less.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the present invention and, together with the description, serve to describe how to make and use the present invention.

DESCRIPTION OF THE EMBODIMENTS

Figure 1A:
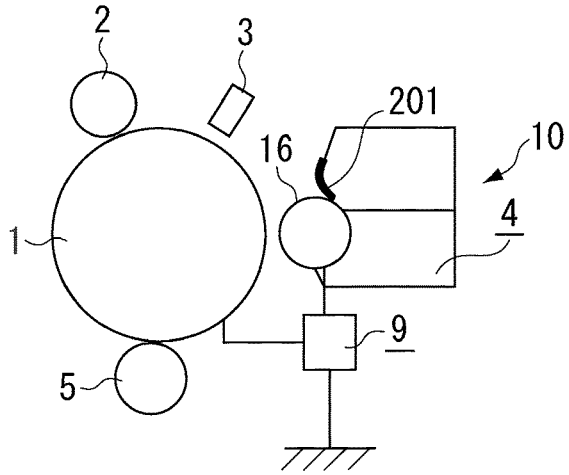
FIGS. 1A and 1B are diagrams illustrating an image forming apparatus according to an embodiment of the present invention.

Various exemplary embodiments, features, and aspects of the invention will be described in detail below with reference to the drawings.

Based on experimentation and consideration by the inventors regarding problems of the prior art, it is considered that the mechanism of the sleeve ghost is deeply involved in a layer of fine particles (particle diameter is 5 to 6 microns or less) formed in the lowermost layer of the toner on the developing sleeve. There is an apparent difference in particle size distribution of the toner in the lowermost layer of the toner on the developing sleeve between the printed area (area on which toner is consumed) and the unprinted area (area on which toner is not consumed). In the area on which toner is not consumed, since toner is not consumed, a fine particle layer tends to be formed in the lowermost layer of the toner. A fine particle has a large surface area per volume, so that a friction charging quantity (specific charge amount) per mass of the fine particle is larger than that of a particle having a larger diameter, and the fine particle is strongly electrostatically attracted to the sleeve by image force. Therefore, toner on a portion where the fine particle layer is formed cannot generate sufficient frictional electrification with the developing sleeve, so that the developing performance of the toner decreases and the toner appears on an image as a ghost.

Furthermore, based on the above noted experimentation and consideration by the inventors, it is considered that the unevenness of the developing performance largely affects unevenness of developing performance and unevenness of developing density caused by unevenness of a specific charge amount of individual toner particles. The non-magnetic toner is easily charged up. Therefore, in particular, in a jumping development without contacting, another non-contact development, and a development method in which the distance between the image bearing member and the developer is very small, the non-magnetic toner causes a decrease of development efficiency and further causes a decrease in density due to repetitive development. In particular, in a developing apparatus used in an image forming apparatus having a high printing speed, a rate for a charge control material or a resin in the developer to contaminate the developing sleeve is high when the non-magnetic toner is used compared with when the magnetic toner is used, so that it results in a further decrease in density due to repetitive development.

Therefore, it may be proposed that an elastic roller be pressed and slid on the surface of the developing sleeve, and the elastic roller and the toner be slid on each other, such that the specific charge amount of the toner contributing to the development is made uniform. However, this method results in a large size and a large torque of the developing apparatus, so that it is difficult to employ this method in a small image forming apparatus from the viewpoints of cost, power, and space. Based in part on these and other considerations, the inventors have developed superior image forming apparatuses which can reduce and frequently avoid the above discussed problems.

Figure 1B:
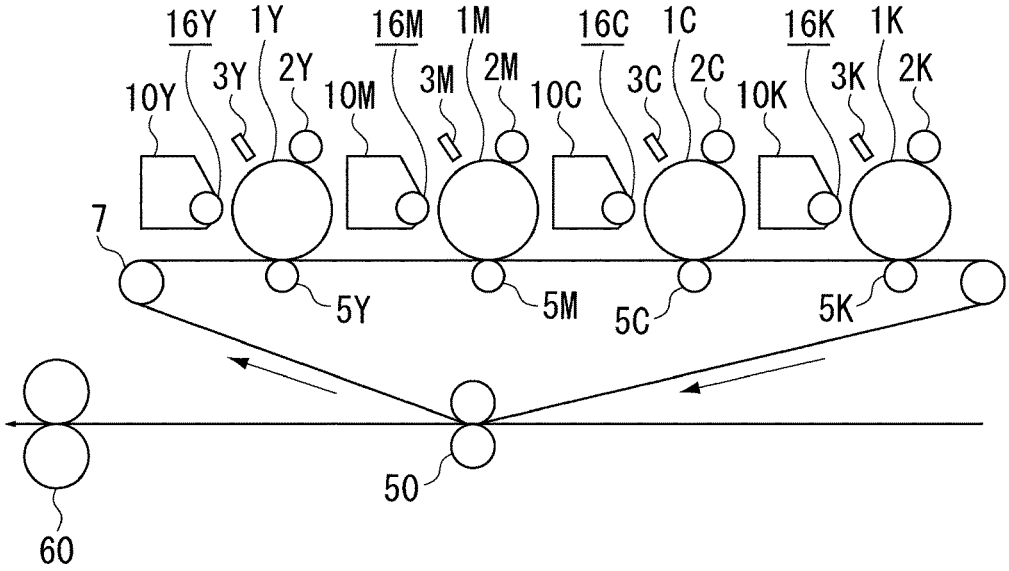

FIG. 1A is a configuration diagram of a cleanerless monochrome image forming apparatus, which illustrates an example of an image forming apparatus according to an embodiment of the present invention. Reference numeral 1 denotes an image bearing member, reference numeral 2 denotes a charging device, reference numeral 3 denotes an exposure device, reference numeral 4 denotes one-component developer, reference numeral 5 denotes a transfer device, reference numeral 16 denotes a developer bearing member, reference numeral 10 denotes a developing apparatus, and reference numeral 201 denotes a developer regulating member. A photosensitive member is used as the image bearing member. This example is referred to as a cleanerless image forming apparatus that does not have a dedicated cleaning device for cleaning toner or the like on the image bearing member. FIG. 1B illustrates an in-line type cleanerless full color image forming apparatus, which is another example of the image forming apparatus. Reference numeral 50 denotes a secondary transfer device and reference numeral 60 denotes a fixing device. Image forming sections for each color, yellow (Y), magenta (M), cyan (C), and black (K) are arranged in line. A toner image (developer image) formed on a photosensitive member is overlapped four times for four colors on an intermediate transfer belt 7, which is an intermediate transfer member, and then the overlapped images are transferred to a transported paper sheet (receiver) by the secondary transfer device 50 at the same time. Thereafter, the toner is fused and fixed to the paper sheet by the fixing device 60, and a full color print image is obtained. In FIG. 1B, constituent elements such as the image bearing member in the image forming sections are given symbols: Y, M, C, or K following a numeral, such as "image bearing member 1Y" for description.

Figure 2A:
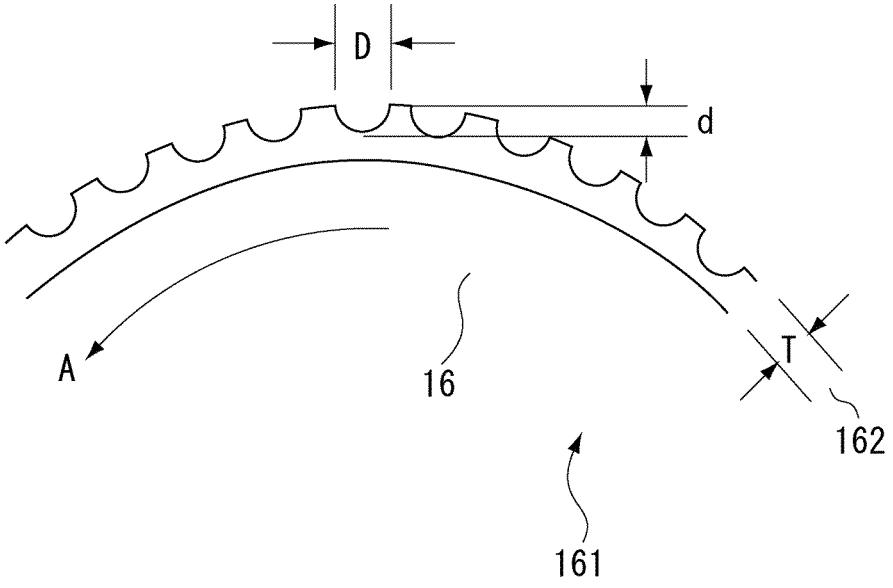
FIGS. 2A to 2C are diagrams illustrating a first example according to a first embodiment of the present invention.

FIG. 2A is an enlarged cross-sectional view of the developer bearing member according to the first embodiment of the present invention. Reference numeral 16 denotes a developing sleeve which is the developer bearing member. First, details of the developer bearing member according to the present embodiment will be described.

Figure 2B:
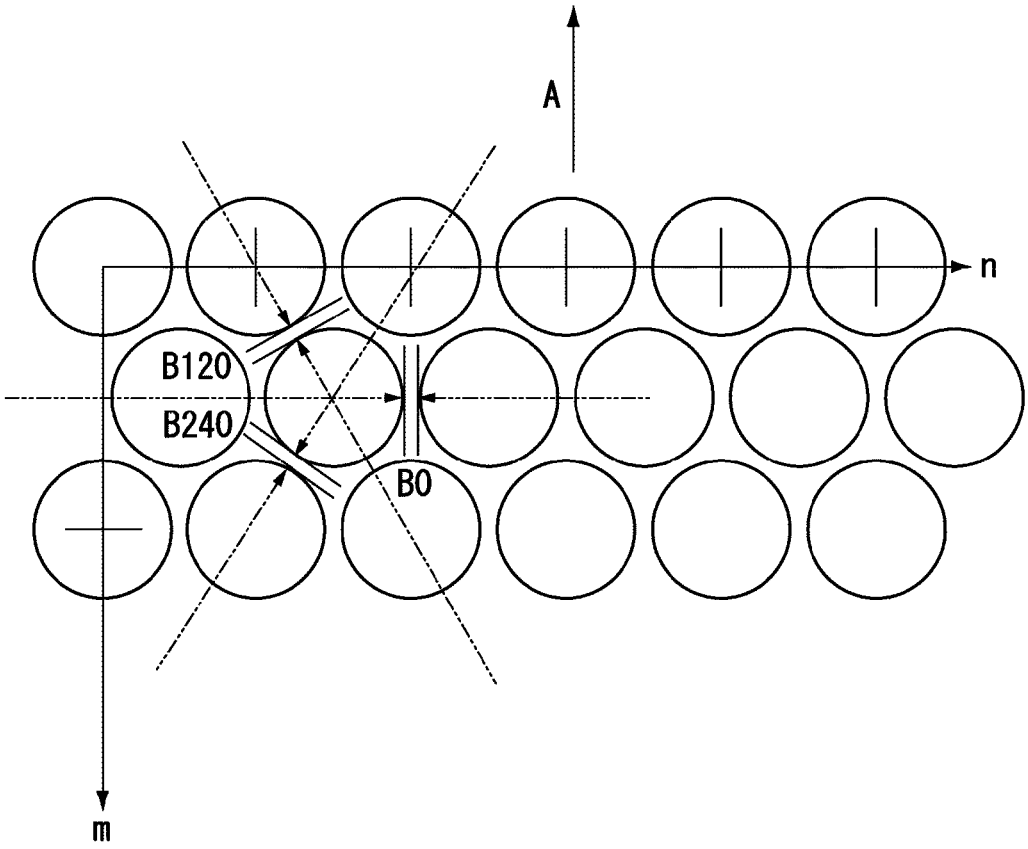
Figure 2C:
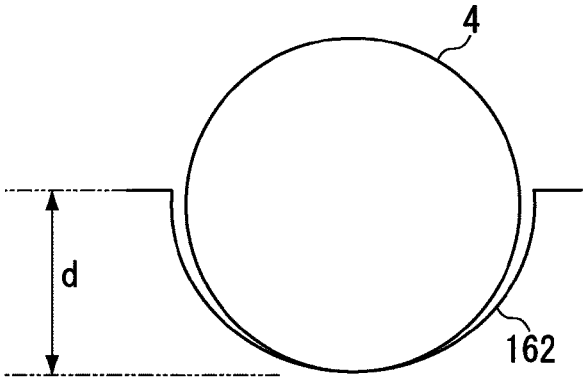

As illustrated in FIG. 2A, the developing sleeve 16 can be divided into a base body 161 and a surface layer 162. In an aspect of the present embodiment, the base body 161 is an aluminum cylinder having a thickness of 0.8 mm and a straightness of 20 μm, and a conductive resin layer having a volume resistance value of $10^2$ Ωm is used as the surface layer 162. As illustrated in FIG. 2A, the surface of the developing sleeve 16 is processed to have concave portions. FIG. 2B is a view of FIG. 2A as seen from above (from the direction of arrow D), and FIG. 2C is an enlarged view of the concave portion in FIG. 2A. In FIG. 2B, a virtual axis n and a virtual axis m perpendicular to the virtual axis n are illustrated to illustrate the arrangement of the concave portions.

The rotation direction of the developing sleeve 16 is illustrated as A. The structure of one concave portion has a circular shape as seen from above (refer to FIG. 2B), and the cross section of the concave portion has a smooth semicircular shape (refer to FIG. 2C). As illustrated in FIG. 2B, in this example, the concave portions are arranged into a hexagonal close-packed structure. Line segments connecting the center of a concave portion and two adjacent concave portions neighboring each other make an angle of 60 degrees. As a definition method of gaps between concave portions, as illustrated in FIG. 2B, a gap between two adjacent concave portions is defined as B. The gaps B corresponding to angles of 0 degrees, 120 degrees, 240 degrees, and so forth from the longitudinal direction of the developing sleeve 16 (n axis direction in FIG. 1B) are respectively defined as B0, B120, B240, and so forth. In this example, it is defined that B0=B60=B120=B180=B240=B300 which is 1 μm and the diameter D of the concave portion is 8 μm.

In the arrangement of this example, when the m axis and the n axis are defined as illustrated in FIG. 2B, the distance between the centers of two adjacent concave portions is represented as "the radius of the concave portion×2+the gap between the concave portions". In this example, the number of the concave portions per unit area is 9926/$mm^2$.

When manufacturing the developing sleeve 16 of this example, a convex mold to form concave portions as illustrated in FIGS. 2A, 2B, and 2C is used. Hereinafter, a specific method will be described.

A conductive resin having a volume resistance value of $10^2$ to $10^8$ Ωm created by the prescription 1 below is prepared on the base body 161, and formed on the base body 161.

(Prescription 1)

Resin: phenol resin, 50 parts by weight

Carbon: carbon black, 45 parts by weight

Solvent: methyl alcohol, and

Methyl cellosolve, 200 parts by weight

The carbon black used here is RAVEN1035 manufactured by Columbia Carbon Corp. and the size of primary particles is submicron or less. The volume resistance value is measured by a resistivity measuring device using a four terminal method (for example, LORESTA AP INTERIGENT manufactured by Mitsubishi Petrochemical Co., Ltd.), and the volume resistivity is about $10^2$ Ω·cm.

The prescription 1 is an aspect of the present embodiment, and it is apparent that the embodiment can be implemented not necessarily by the resin and the conductive fine particles. However, to form a three-dimensional shape including the concave portions of the present embodiment, it is apparent that the size of the conductive particles such as carbon or graphite is desired to be sufficiently smaller than the size of the concave portion so that the three-dimensional shape can be stably formed. Specifically, it is desirable to use carbon having a particle diameter smaller than the diameter of the concave portion to be formed.

In the present embodiment, a dimensional tolerance is ±0.5 μm, so that the primary particle diameter of the carbon black is selected to be 0.5 μm or less. The RAVEN1035 manufactured by Columbia Carbon Corp. shown in prescription 1 is used.

The concave portions are formed in a manner described below. First, a layer thickness T (refer to FIG. 2A) of the surface layer 162 is formed to have a thickness of about 10 μm by spraying or dipping. The convex mold to form the shape of this example is heated and pressed onto the entire developing sleeve 16, and then the convex mold is held under a condition sufficient to transfer the shape. In this example, the mold is held under a condition of 150° C. and 30 minutes, and the developing sleeve 16 having a fine structure illustrated in FIGS. 2A and 2B is manufactured. Here, the depth d of the concave portion illustrated in FIG. 1C is formed to be 4 μm.

By such a nano-imprint process, the fine structure is formed with a degree of accuracy of ±0.5 μm or less (dimensional tolerance of diameter and depth). The nano-imprint process is a fine processing technology in which a mold having a concave-convex shape of nano order on its surface is pressed onto a resin or the like and the shape is transferred to the resin or the like.

Figure 3:
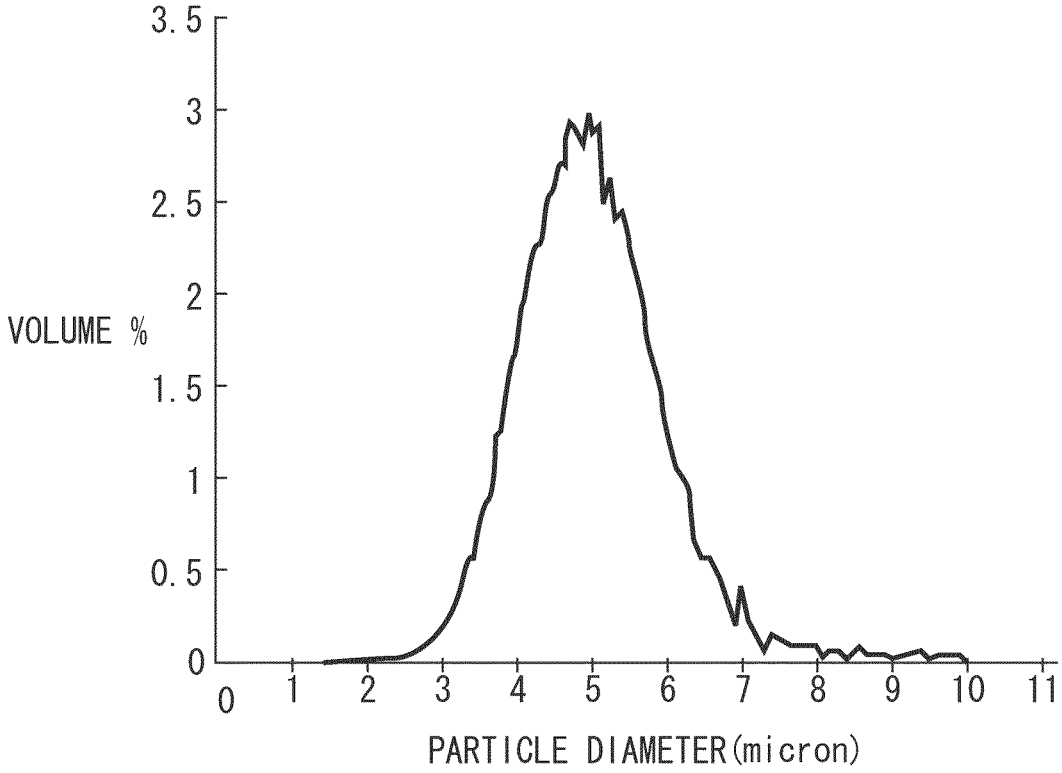
FIG. 3 is a diagram illustrating toner particle size distribution according to the first embodiment.

The one-component developer to be used is a non-magnetic toner 4. The toner has a volume average particle diameter of 5 μm as particle size and a degree of circularity (described below) of approximately 0.96. FIG. 3 illustrates a volume particle size distribution of the toner used in the present embodiment.

In an aspect of the present embodiment, non-magnetic one-component jumping development is used for consideration.

The developing bias used in this example is supplied to the developing sleeve 16 of A4 size by a high-voltage power supply 9. The developing bias is obtained by superimposing an AC bias on a DC bias, and the AC bias has a peak voltage Vpp of 1600 V and a frequency of 1800 Hz. The gap between the developing sleeve 16 and the image bearing member 1 of the present embodiment is approximately 300 μm. The process speed is about 94 mm/sec. A reversal development method is used in which a negative-polarity toner is used, a receiving voltage of the image bearing member is −700 V, a light potential is −100 V, and a developing bias is −500 V.

As a comparative example for the present embodiment, a developing sleeve obtained by sandblasting the developing sleeve 16 with Alundum #400 is prepared. The processing condition of the above is that a sandblasting apparatus manufactured by Fuji Manufacturing Co., Ltd. is used, sandblasting pressure is approximately 3.5 kg/cm$^2$, and processing time of abrasive grains is approximately 30 seconds. When outputting an image by using the same non-magnetic toner 4 and developing bias as those of the present embodiment, it was confirmed that the sleeve ghost was improved in the present embodiment compared with the comparative example and the density uniformity was also improved in the present embodiment. The result is shown in Table 1. In the surface of the developing sleeve 16 processed with Alundum #400 shown as the comparative example, an average line center roughness Ra specified in JISB0601 is about 0.4 μm, and a 10-point average roughness Rz (specified in JISB0601) corresponding to the depth of the concave portion is approximately 5 μm.

TABLE 1

| | Sleeve ghost | Durable density/Uniformity | | | | | |
|---|---|---|---|---|---|---|---|
| Item | Initial/10K/25K | Initial | 5K | 10K | 15K | 20K | 25K |
| Example 1-1 | A/A/B | 1.5/ 0.01 | 1.5/ 0.01 | 1.5/ 0.01 | 1.5/ 0.01 | 1.4/ 0.01 | 1.4/ 0.02 |
| Comparative example | D/D/D | 1.5/ 0.01 | 1.3/ 0.2 | 1.2/ 0.4 | 1.0/ 0.4 | 0.8/ 0.4 | 0.5/ 0.4 |

Table 1 shows a result of a comparative experiment performed for the sleeve ghost, durable density, and density uniformity in a page. Regarding the sleeve ghost, sleeve ghosts of a relatively new developing apparatus, a developing apparatus after printing 10000 pages (represented as 10K) in an endurance test (test for outputting images), and a developing apparatus after printing 25000 pages (represented as 25K) in the endurance test are compared. The durable density is evaluated in a manner in which, an all black image is output, and the density of the all black image is measured by using a.

Macbeth reflection density meter (RD-918 manufactured by Macbeth Co.) as a relative density to an image of a white portion having the relative density of 0.00. The uniformity is evaluated, in the same page, by using a maximum value of differences between an average value of the reflection densities of five points including four corners and the center and values of the reflection densities at each point.

Figure 4:
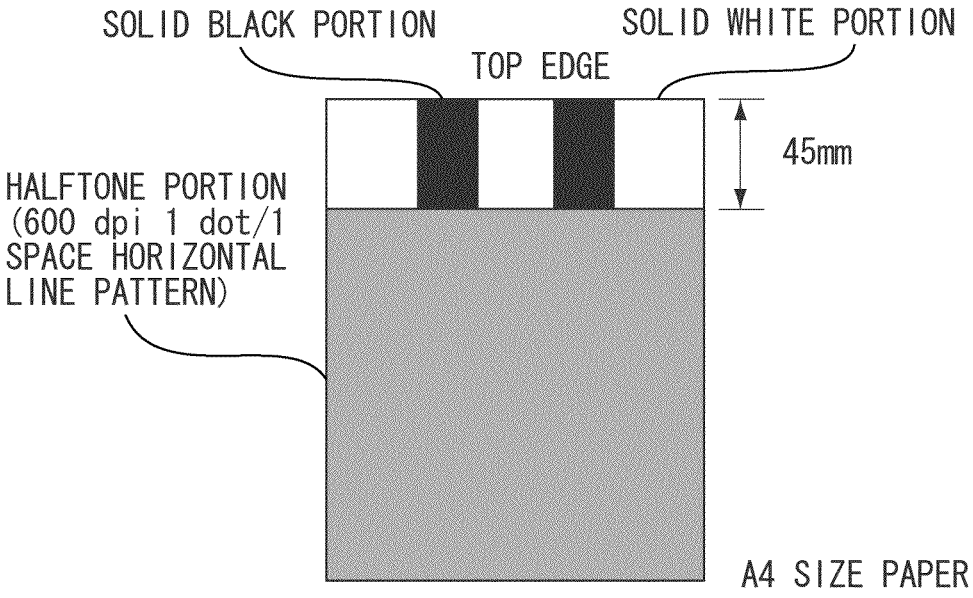
FIG. 4 is a diagram illustrating a sleeve ghost test pattern according to the first embodiment.

The sleeve ghost is evaluated by outputting an image using a test pattern as illustrated in FIG. 4. The test pattern is an image in which entire white portions and entire black portions are arranged adjacent to each other in an area having a depth of 45 mm from the top edge, and, below the area, a halftone image of horizontal lines of 1 dot/1 space is formed. The image of the test pattern is printed on an A4 size paper sheet, and differences in density on the obtained halftone image are visually observed, and then, evaluated using A, B, C, and D.

The criterion of the evaluation is as follows:

A: no difference is observed in density

B: a slight difference is observed in density

C: although some difference is observed in density, it is an acceptable level

D: a significant difference is observed in density, not an acceptable level

In an aspect of the present embodiment, the sleeve ghost is not observed until the endurance test of 10K, and even at 25K, it is an acceptable level. On the other hand, in the comparative example, the sleeve ghost is observed from an initial stage. Furthermore, as the endurance test proceeds, the density decreases and the density in a page shows an appreciable nonuniformity. In particular, the nonuniformity in a page shows a phenomenon that the density decreases in an area corresponding to one rotation of the sleeve.

The reasons why the sleeve ghost disappears in an aspect of the present embodiment are considered to be as follows. One reason is that the specific charge amount of the toner on the developing sleeve 16 is uniform due to the structure including fine concave portions as illustrated in FIGS. 2A to 2C. The other reason is considered that the uniform circulation of the toner in the fine areas is quickly performed. In other words, it is indicated that the toner coating state on the developing sleeve 16 is uniform.

Figure 5:
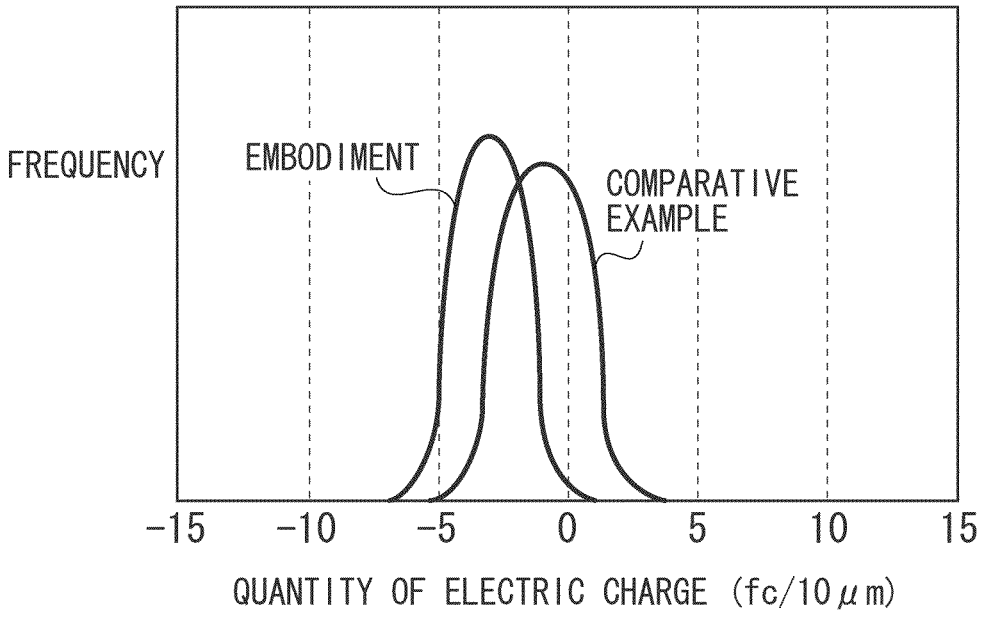
FIG. 5 is a diagram illustrating second to fifth examples according to the first embodiment.

To examine the above phenomenon, the specific charge amount distribution (Charge/Diameter (fc/10 μm)) of the toner on the developing sleeve 16 is measured by E-SPART analyzer manufactured by Hosokawa Micron Corp. and the result is illustrated in FIG. 5. (In FIG. 5, the vertical axis is frequency and the horizontal axis is amount of electric charge.) As apparent from FIG. 5, in the comparative example, the specific charge amount distribution is broad, there are a lot of inversely charged toner components (positively charged toner), and the center value is not so high. This is because the shape of the surface of the sleeve sandblasted by Alundum #400 is nonuniform, so that the contact probability between the toner and the surface of the sleeve is nonuniform, and as a result, it is impossible to sharpen the specific charge amount distribution. On the other hand, in an aspect of the embodiment, the inversely charged toner component is hardly observed (in an aspect of the present embodiment, it is observed to be less than 10%), the specific charge amount distribution is sharp, and it is understood that the center value is improved to be a value relatively higher than that of the comparative example.

As described above, the specific charge amount of the toner becomes sharp, the absolute value shifts to a higher level, and a uniform coating state can be formed, so that the sleeve ghost is improved, and the nonuniformity of density is improved not only in the initial stage of the endurance test but also throughout the endurance test.

As another example of the present embodiment, a result of an examination in which the depth d of the concave portion in FIGS. 2A and 2C is used as a parameter is shown in Table 2.

The other conditions are the same as those in the example 1.

TABLE 2

| Item | Depth of concave portion | Sleeve ghost Initial/10K/25K | Durable density/Uniformity Initial | 5K | 10K | 15K | 20K | 25K |
|---|---|---|---|---|---|---|---|---|
| Example 1-2 | 2 | A/A/B | 1.5/ 0.01 | 1.5/ 0.01 | 1.5/ 0.01 | 1.4/ 0.01 | 1.4/ 0.02 | 1.4/ 0.02 |
| Example 1-3 | 1 | A/A/B blotch C | 1.5/ 0.01 | 1.5/ 0.01 | 1.5/ 0.01 | 1.4/ 0.01 | 1.3/ 0.02 | 1.3/ 0.02 |
| Example 1-4 | 5 | A/A/B | 1.5/ 0.01 | 1.5/ 0.01 | 1.5/ 0.01 | 1.5/ 0.01 | 1.4/ 0.02 | 1.4/ 0.02 |
| Example 1-5 | 6 | B/B/B Negative ghost tends to occur | 1.5/ 0.01 | 1.5/ 0.01 | 1.5/ 0.01 | 1.4/ 0.01 | 1.4/ 0.02 | 1.4/ 0.02 |

As shown in Table 2, the evaluation is performed by changing the depth d of the concave portion from 1 μm to 6 μm. As shown in an example 3 of the present embodiment, when the depth d of the concave portion is 1 μm, a blotch phenomenon appears which is apparent for those skilled in the art and in which the toner coating state on the developing sleeve 16 has a ripple shape. This is a phenomenon which appears when the concave/convex on the sleeve becomes considerably small.

When the depth d of the concave portion is 6 μm or more, even though an improvement effect of the sleeve ghost is observed, a negative ghost phenomenon appears in which the density at the top edge is high and the density decreases after the sleeve rotates once.

Therefore, it is considered that the depth of the concave portion on the sleeve can be about 2 to 5 μm.

Figure 6:
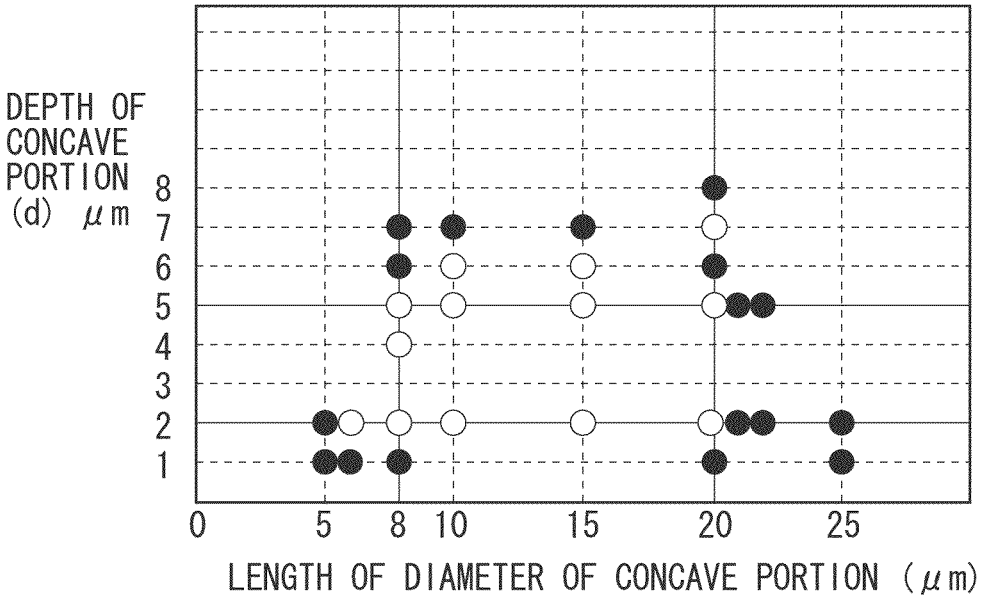
FIG. 6 is a diagram illustrating sixth and subsequent examples according to the first embodiment.

FIG. 6 illustrates a result of an examination of an example in which the diameter D of the concave portion and the depth d of the concave portion are used as parameters. The other conditions are the same as those in the example 1. In FIG. 6, the unfilled circle indicates a concave portion where the sleeve ghost is improved and the durable density stability and the uniformity are in an allowable range for a practical use. The filled circle indicates a concave portion where, even though an improvement effect of the sleeve ghost is observed to some extent, the blotch tends to appear and the above-described negative ghost phenomenon tends to appear.

As the reason of the above, it is considered that the larger the diameter D of the concave portion, the larger the fluctuation and the movement of the average toner particle in the concave portion, so that relative charging performance tends to increase, but the attraction of the toner becomes small. In other words, it is estimated to be because the blotch tends to appear by a stick-slip phenomenon. Further, it is considered that, when the diameter D of the concave portion is small, the toner cannot enter the concave portion, and a contact area decreases, so that the charging performance to be given decreases, and thus, the density stability improvement tends to decrease.

In summary, when the depth d of the concave portion is set to 2 μm to 5 μm and the diameter D of the concave portion is set to 8 μm to 20 μm, the improvement of the sleeve ghost, the durable density stability, and the uniformity can be achieved.

When the toner comes into contact with the concave portion, the toner can receive an electric charge from the developing sleeve. However, when the average particle diameter of the toner is approximately 5 μm, the diameter D of the concave portion can be 8 μm or more and 20 μm or less as determined from the particle size distribution of the toner.

The number of the concave portions per unit area when the concave portions are arranged into a hexagonal close-packed structure as shown in the present embodiment will be examined. When the diameter of the concave portion is 8 μm and the gap between the concave portions is 1 μm, if the concave portions are arranged into a close-packed structure, the calculation of the number of the concave portions per unit area is replaced by "how many circles having a diameter of 9 μm are closely packed in a unit area". When the diameter of the concave portion is 8 μm, the coefficient of the close-packed structure is $0.7796[=\sqrt{18}\times(\mathrm{COS}^{-1}\ 1/3-\pi/3)]$, so that the number of the concave portions per 1 $mm^2$ is $(0.7796/(4.5\times10^{-3})^2\times\pi=)$ about 12254/$mm^2$.

When the diameter of the concave portion is 20 μm, if the gap between the concave portions is 1 μm, the calculation of the number of the concave portions per unit area is replaced by "how many circles having a diameter of 21 μm are closely packed in a unit area". When the diameter of the concave portion is 20 μm, the coefficient of the close-packed structure is $0.7796[=\sqrt{18}\times(\mathrm{COS}^{-1}\ 1/3-\pi/3)]$, so that the number of the concave portions per 1 $mm^2$ is $(0.7796/(10.5\times10^{-3})^2\times\pi=)$ about 2250/$mm^2$.

In the above calculation, the number of the concave portions in a unit area is obtained when the concave portions are closely packed assuming that the gap between the concave portions is 1 μm in a desired range of the diameter of the concave portion. It is considered that the number of the concave portions per unit area when the concave portions are closely packed changes depending on the value of the gap between the concave portions. However, at least in a range between 2250/$mm^2$ to 12254/$mm^2$ described above, it is confirmed that the effect of the present invention can be obtained. Therefore, it is considered that, even when the gap between the concave portions changes, if the number of the concave portions in a unit area is in the range described above, the effect of the invention can be obtained.

As described in the embodiment, the volume resistivity of the developing sleeve is measured by a resistivity measuring device using a four terminal method (for example, LORESTA AP INTERIGENT manufactured by Mitsubishi Petrochemical Co., Ltd.), and the volume resistivity is about $10^2$ Ω·cm. The applied voltage at this time is 5 V.

The diameter of the concave portion, the depth of the concave portion, the number of the concave portions, and the dimensional tolerance are measured by a contactless three-dimensional shape measuring device (for example, Microscope VHX-S15 series manufactured by Keyence Corp.).

To form the fine structure of the present embodiment, in the description of the present embodiment, a finely processed mold is heated and pressed onto the developer bearing member. In addition to the above, it is also possible to process more precisely by adding a material using ultraviolet (UV) radiation effect on the surface layer of the developing sleeve 16, using a finely processed mold using a translucent material, and irradiating light from the outside of the mold.

A characterizing portion of the present embodiment is that the concave portions having approximately the same shape are arranged on the developing sleeve 16, and the number of the concave portions per unit area is in a certain range. The shape of the concave portion is formed into a shape similar to the particle shape of the toner to be used, so that the toner is held in the concave portion, and electric charge is properly transferred from the developing sleeve to the toner. Since the concave portions having a shape similar to the shape of the toner are provided, electric charge is uniformly transferred to the toner, and thus the specific charge amount distribution of the toner can be sharpened. For example, in the case of the sandblast process described in the conventional example, even if concave portions are provided, the size of the concave portions varies, so that the specific charge amount distribution of the toner tends to be broad. Also, when using a developing roller on which knurled pattern grooves are provided as described in the background of the invention, the specific charge amount distribution of the toner tends to be broad.

To provide the concave portions having approximately the same shape, in the present embodiment, the dimensional tolerances of the depth and the major diameter of the concave portion are set to 0.5 μm or less. The major diameter of the concave portion, the depth of the concave portion, and the number of the concave portions per unit area are determined based on the range in which the specific charge amount distribution can be sharpened by measuring the specific charge amount of the toner using normally used toner having an average particle diameter of 4 to 6 μm. At least the major diameter of the opening of the concave portion is larger than the average particle diameter of the toner.

Figure 7A:
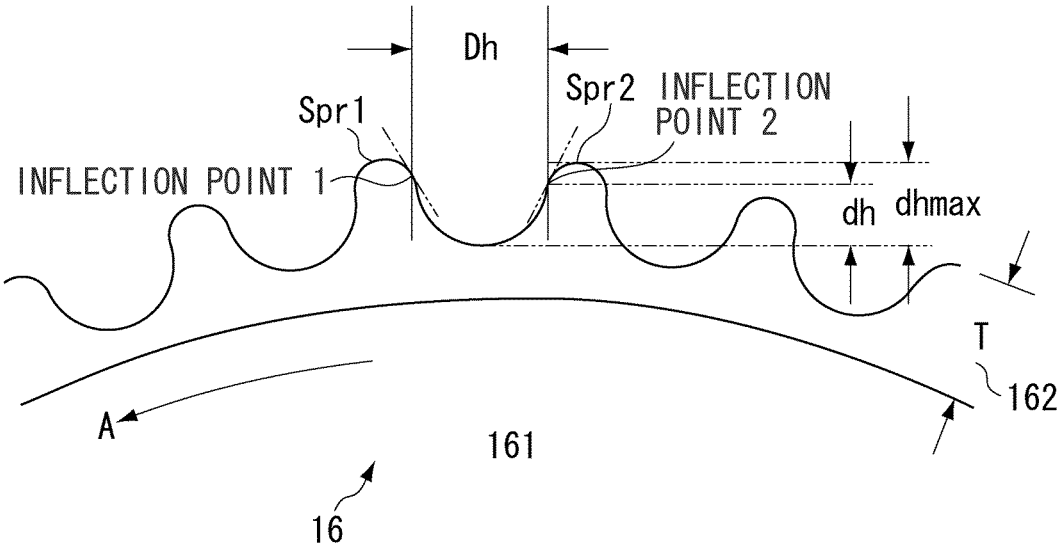
FIGS. 7A to 7C are diagrams illustrating a first example according to a second embodiment of the present invention.

FIG. 7A is an enlarged cross-sectional view of the developing sleeve 16 according to a second embodiment of the present invention. In the configuration of the developing apparatus, the members that operate in the same way as those in the first embodiment are given the same reference numerals and further description thereof is omitted if not necessary.

The present embodiment is characterized in that the shape of the surface of the developer bearing member has no three-dimensional angle. In FIG. 7A, when the left profile of the cross-section of one concave portion of the developing sleeve 16 is defined as Spr1 and the right profile is defined as Spr2, there are an inflection point 1 in the left profile Spr1 and an inflection point 2 in the right profile Spr2. The left profile Spr1 and the right profile Spr2 are continuously connected to each other in the profiles and form a concave portion. They are characterized by having no sharp angle. Here, the sharp angle indicates that the symbol of first differential of the profiles Spr1 and Spr2 changes at a certain point. The present embodiment is characterized in that the shape of the surface of the developing sleeve 16 is characterized by having no sharp angle. Although the above description uses a two-dimensional plane for ease of description, actually, the surface has a three-dimensional shape, characterized by having no sharp point and no sharp line.

The developing sleeve 16 used in an example of the present embodiment is formed by the prescription 1 in the same manner as in the first embodiment. To form the shape of the surface into the above-described three-dimensional shape, a convex mold having a shape with no angle is manufactured, and the developing sleeve 16 is manufactured by using the same processing method as that in the first embodiment.

Figure 7B:
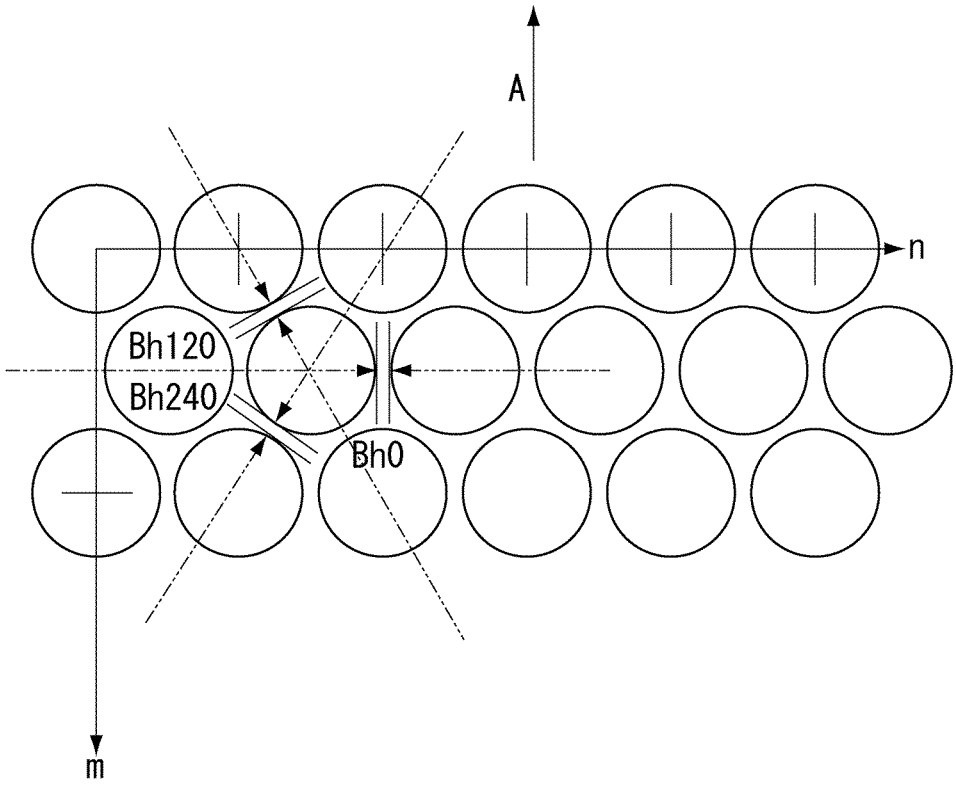
Figure 7C:
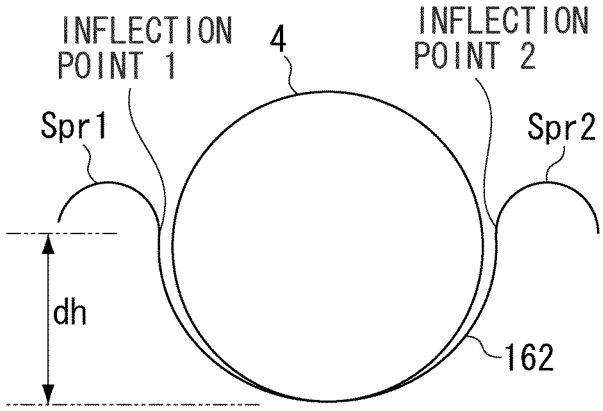

As illustrated in FIG. 7C, the distance Dh between inflection points in a concave portion and the depth dh of a partition wall inflection point of the shape of each concave portion in the present embodiment are defined by the distance between the inflection points in the profiles Spr1 and Spr2. As a method for defining the depth of the partition wall inflection point, as illustrated in FIG. 7B, in a similar manner to that in the first embodiment, the gaps corresponding to angles of 0 degrees, 120 degrees, and 240 degrees from the longitudinal direction of the developing sleeve 16 are respectively defined as Bh0, Bh120, and Bh240.

The maximum height of partition wall dhmax is defined and the depth between partition walls Δdh (=dhmax−dh) is defined.

The evaluation result of the present embodiment is shown in Table 3. Here, the distance Dh between inflection points in a concave portion is 8 μm, the depth dh of the partition wall inflection point is 4 μm, the gaps are Bh0=Bh60=Bh120=Bh180=Bh240=Bh300=1 μm, and the depth between partition walls Δdh is 0.5 μm.

TABLE 3

| | Sleeve ghost | Durable density/Uniformity | | | | | |
|---|---|---|---|---|---|---|---|
| Item | Initial/10K/25K | Initial | 5K | 10K | 15K | 20K | 25K |
| Example 2 | A/A/B | 1.5/ 0.01 | 1.5/ 0.01 | 1.5/ 0.01 | 1.5/ 0.01 | 1.5/ 0.01 | 1.5/ 0.02 |
| Example 1-1 | A/A/B | 1.5/ 0.01 | 1.5/ 0.01 | 1.5/ 0.01 | 1.5/ 0.01 | 1.4/ 0.01 | 1.4/ 0.02 |
| Comparative example | D/D/D | 1.5/ 0.01 | 1.3/ 0.2 | 1.2/ 0.4 | 1.0/ 0.4 | 0.8/ 0.4 | 0.5/ 0.4 |

In the configuration of the second embodiment, the change of the durable density is smaller than that in the configuration of the example 1-1, so that a good result is obtained. The above results indicate that the durable density is maintained throughout the endurance test and the uniformity in a page increases in addition to that the sleeve ghost is improved. This seems to indicate that damage to the toner decreases, durability increases, and the specific charge amount increases uniformly by the fine structure of the developing sleeve 16 having no angle of the present embodiment.

Figure 8:
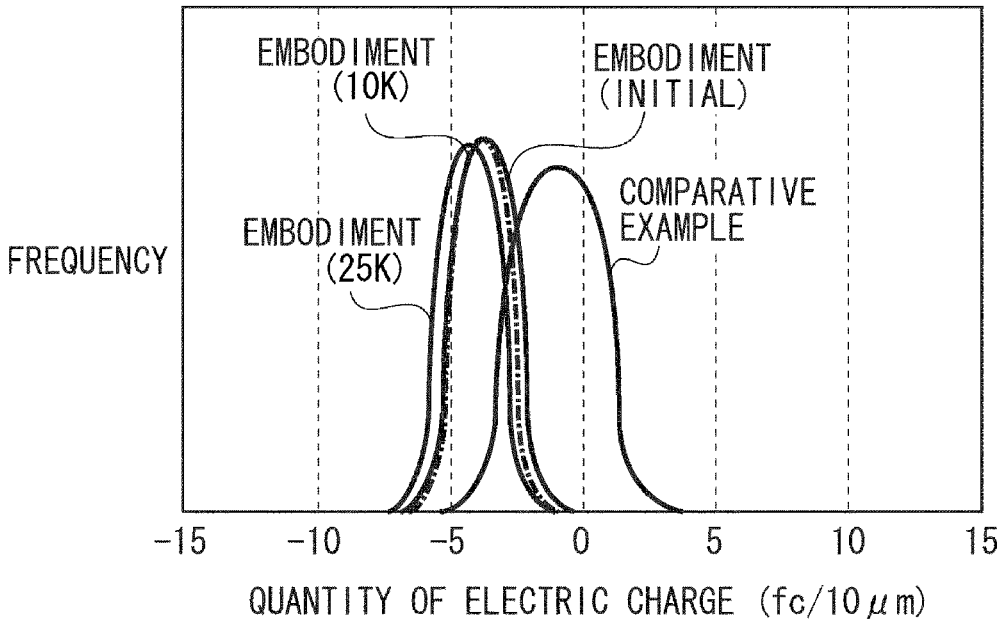
FIG. 8 is a diagram illustrating the first example according to the second embodiment.

Therefore, under the same condition as in the first embodiment, the specific charge amount distribution (Charge/Diameter (fc/10 μm)) of the toner on the developing sleeve 16 is measured. In the measurement, the toner in the initial stage of the endurance test and the toners after the 10K endurance test and the 25K endurance test are sampled and measured. The result is illustrated in FIG. 8. In FIG. 8, the toner in the initial stage is indicated by a dashed-dotted line.

As illustrated in FIG. 8, in each of Initial, 10K, and 25 k, a change of the peak position of the amount of electric charge is small and also a change of the charge amount distribution is small. In the present embodiment, it is possible to prevent deterioration of the toner in the endurance test and sharpen the specific charge amount distribution by forming a three-dimensional fine structure having no angle on the developing sleeve 16.

As another example of the present embodiment, the effect of the present embodiment is examined by changing the distance Dh between inflection points in a concave portion from 5 μm to 25 μm and changing the depth dh of a partition wall inflection point from 1 μm to 8 μm. In the example of the present embodiment, the depth between partition walls Δdh (=dhmax−dh) is changed from 0.5 μm to 1.0 μm.

Figure 9A:
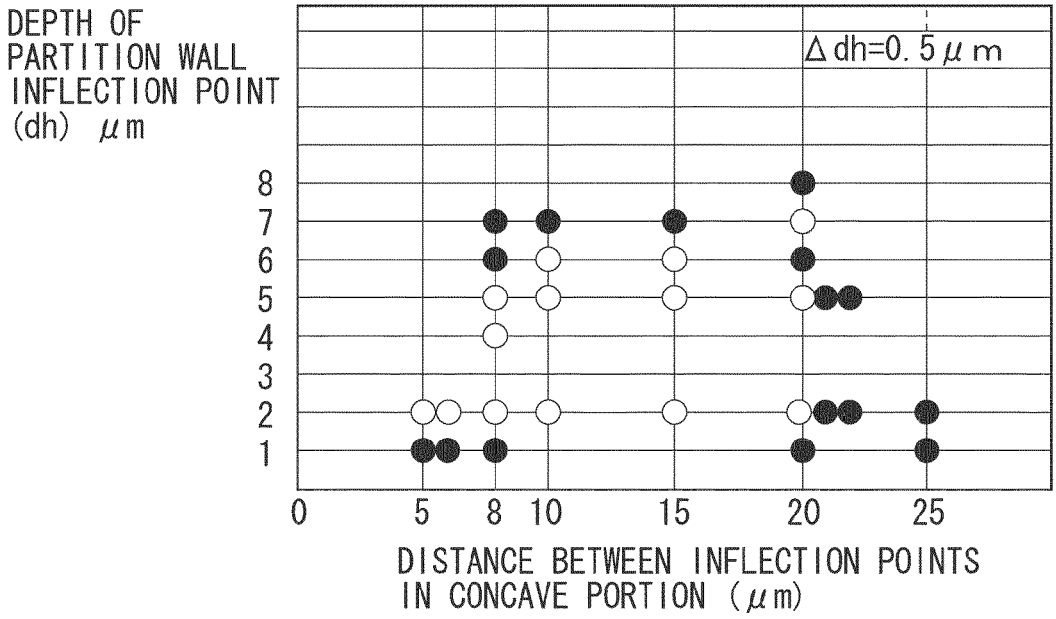
FIGS. 9A and 9B are diagrams illustrating other examples according to the second embodiment.
Figure 9B:
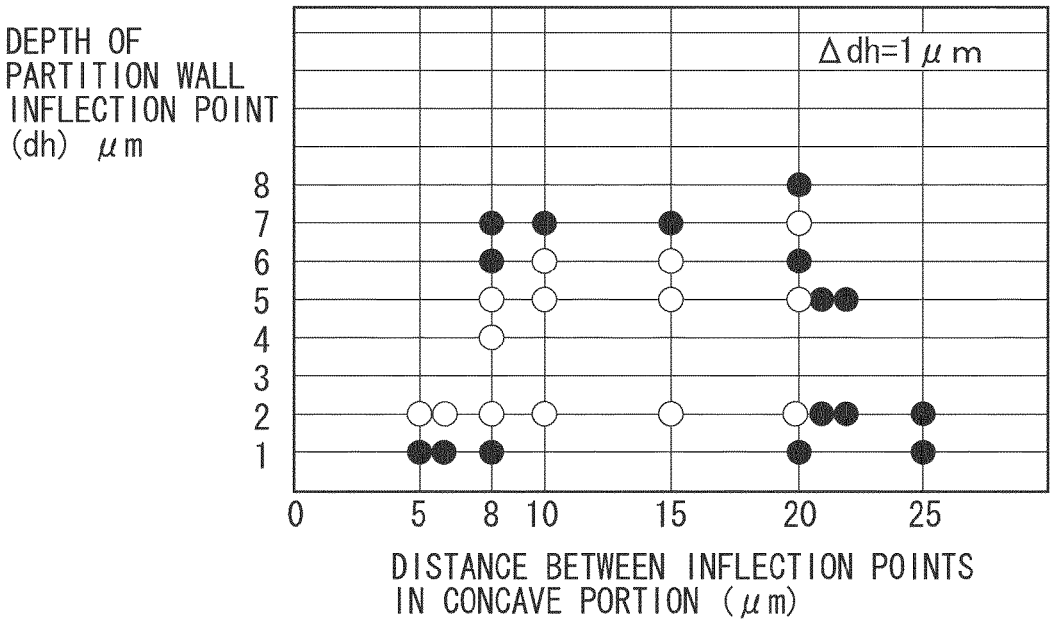

FIGS. 9A and 9B illustrate results in which the sleeve ghost and the durable density change are plotted on a graph and evaluated in the same manner as described above.

FIG. 9A illustrates a result when the depth between partition walls Δdh is 0.5 μm, and FIG. 9B illustrates a result when the depth between partition walls Δdh is 1.0 μm. The reason why the depth between partition walls Δdh is changed is because it is considered that the contact state between the toner and the developing sleeve surface changes according to the depth between partition walls Δdh.

From the above example, the improvement of the sleeve ghost, the developing density stability, and the durable density stability and uniformity are examined by changing the distance Dh between inflection points in a concave portion from 5 μm to 25 μm, changing the depth dh of a partition wall inflection point from 1 μm to 8 μm, and changing the depth between partition walls Δdh from 0.5 μm to 1.0 μm. As a result, as illustrated in FIGS. 9A and 9B, improvements in the above items are observed when the distance Dh between inflection points in a concave portion is 8 μm to 20 μm and the depth dh of a partition wall inflection point is 2 μm to 5 μm. The distance Dh between inflection points and the depth dh of a partition wall inflection point in the second embodiment correspond respectively to the diameter D of the concave portion and the depth d of the concave portion in the first embodiment.

Figure 10A:
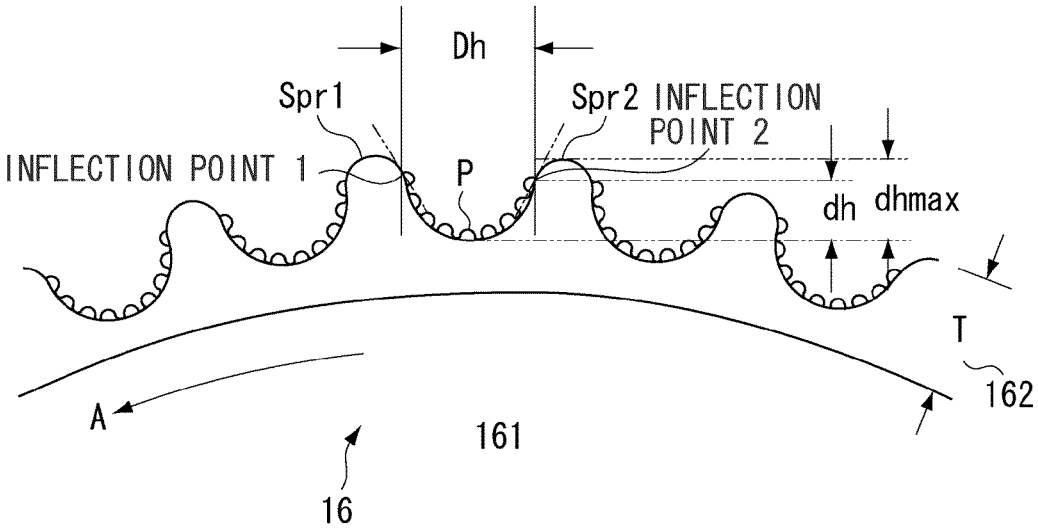
FIGS. 10A and 10B are diagrams illustrating a first example according to a third embodiment of the present invention.
Figure 10B:
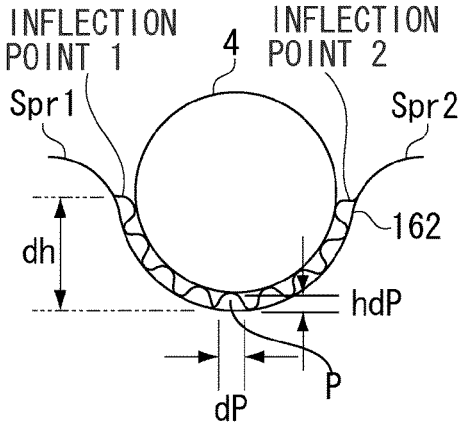

FIG. 10A is an enlarged cross-sectional view of the developing sleeve 16 according to a third embodiment of the present invention. In the configuration of the developing apparatus, the members that operate in the same way as those in the first embodiment are given the same reference numerals and further description thereof is omitted if not necessary.

The present embodiment is characterized in that fine structures having a convex shape are included inside the concave portion of the developer bearing member.

In FIG. 10A, the fine structure is indicated by P, and has a convex shape. In the present embodiment, convex shapes are included inside the concave structure of the first embodiment and the second embodiment. The horizontal length dP of the fine structure having a convex shape in the present embodiment is 0.8 μm and the height hdP is 0.4 μm. Nine convex shapes are formed inside the concave portion.

Figure 11:
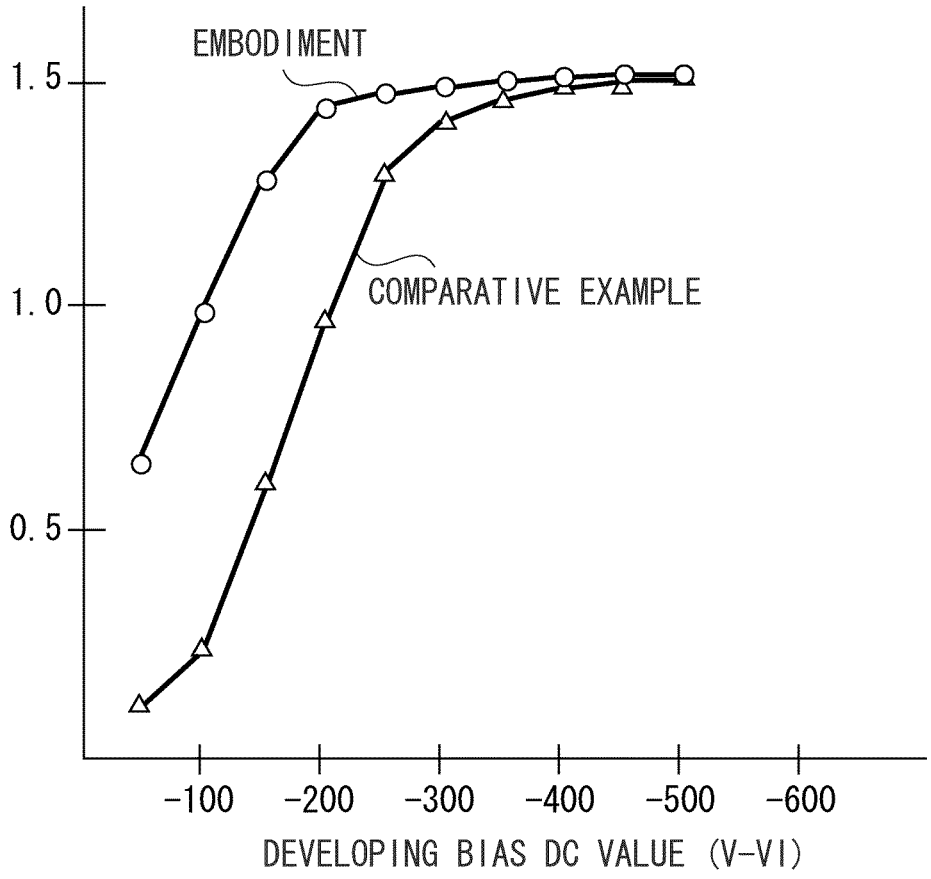
FIG. 11 is a diagram illustrating an example according to the third embodiment of the present invention.

To examine the effect of the present embodiment, the density is measured while changing the DC component of the developing bias by using the same developing apparatus as that in the first embodiment. The result is illustrated in FIG. 11. In FIG. 11, the horizontal axis is a value calculated by subtracting a light potential (V1) from a developing bias DC value, and the vertical axis indicates the density of an entire black portion.

As illustrated in FIG. 11, by using the developer bearing member of the present embodiment, at the developing bias value about 100 V lower than that of the comparative example, the same density as that in the comparative example can be obtained.

It is considered that the toner is more easily separated from the developer bearing member, and it can be estimated that this is caused by the effect of the concave fine structures in the convex structure of the present embodiment. Examination is performed by changing the length dP of the fine structure from 0.2 μm to 1.0 μm and changing the height hdP from 0.1 μm to 0.6 μm, and the same increase in the developing density as that in FIG. 11 is observed. In the same manner as in the first and second embodiments, the improvement effect in the sleeve ghost is also observed.

Figure 12A:
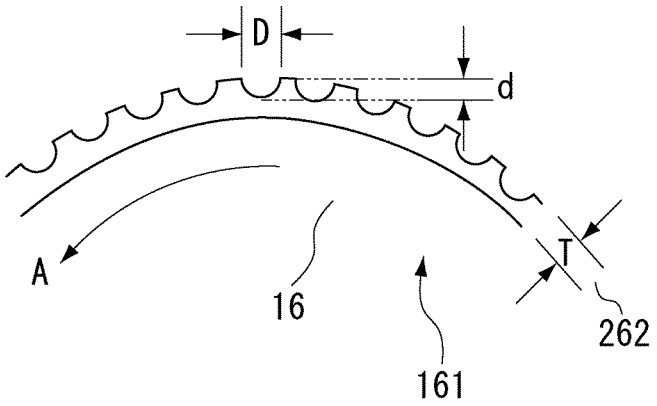
FIGS. 12A to 12C are diagrams illustrating an example according to a fourth embodiment of the present invention.
Figure 12B:
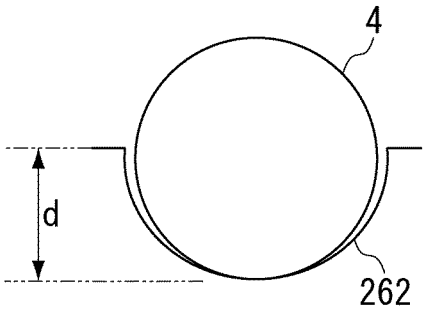

FIG. 12A is an enlarged cross-sectional view of the developing sleeve 16 according to a fourth embodiment of the present invention. In the configuration of the developing apparatus, the members that operate in the same way as those in the first embodiment are given the same reference numerals and further description thereof is omitted if not necessary.

The present embodiment is characterized by including a conductive elastic layer 262 having hardness of 5 or more in SRIS 0101 hardness (Asker C hardness) and hardness of 30 or less in hardness measured according to JIS K-6301. Although the shape of the concave portion can be applied to the shape of both the first embodiment and the second embodiment, in the present embodiment, examination is performed using the shape of the first embodiment, and the result will be described below.

As an example of the present embodiment, a sleeve is used in which the conductive elastic layer has hardness of 20 to 25 degrees in SRIS 0101 hardness (Asker C hardness) and a volume resistance value of $10^4$ Ω·cm. The sleeves in the first to third embodiments have a pencil hardness of H or more in JIS K-5400. In the measurement of hardness of the sleeves of the first to third embodiments, JIS K-5400 is used instead of Asker C hardness which is used in the fourth embodiment. This is because the sleeves of the first to third embodiments have hardness higher than that of the sleeve of the fourth embodiment. Therefore, the hardness of the sleeves of the first to third embodiments cannot be measured in terms of Asker C hardness.

Regarding the developing sleeve 16, the conductive elastic layer 262 is formed by adding conductive carbon to urethane rubber and mixing them on the base body 161 made of metal (in the present embodiment, SUS304), and first stage processing is performed. Thereafter, the processed material is put into a mold illustrated in FIG. 12A and formed into the developing sleeve 16 by vulcanization.

In the present embodiment, in the same measuring method as in the first embodiment, the volume resistance value of the conductive elastic layer 262 is measured. The volume resistance value is $10^4$ Ω·cm.

Figure 12C:
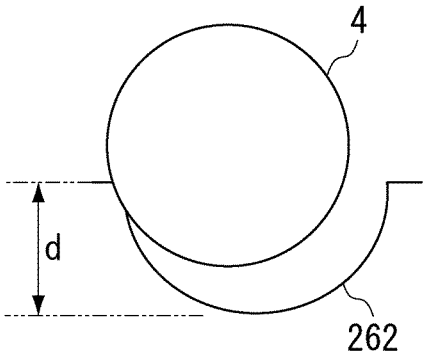

In the present embodiment, the outermost layer of the developing sleeve 16 is the conductive elastic layer 262. Therefore, as illustrated in FIG. 12C, even when the toner 4 is shifted from the center of the concave structure, the surface layer of the conductive elastic layer generates microscopic deformation, so that damage to the toner 4 is reduced.

In the same way, at all points at which the toner 4 is in contact with the developing sleeve 16, the above phenomenon occurs, and damage to the toner is reduced. In the hardness of the present embodiment, it is considered that the developer bearing member encloses toner, so that the contact area increases, and the specific charge amount of the toner 4 tends to increase.

In a first example of the present embodiment (example 4-1), the developer regulating member 201 of the developing apparatus 10 is made of urethane.

In a second example of the present embodiment (example 4-2), the developer regulating member 201 of the developing apparatus 10 is made of metal (phosphor bronze). For comparison, the developing sleeve shown in example 1-1 is used.

Figure 13:
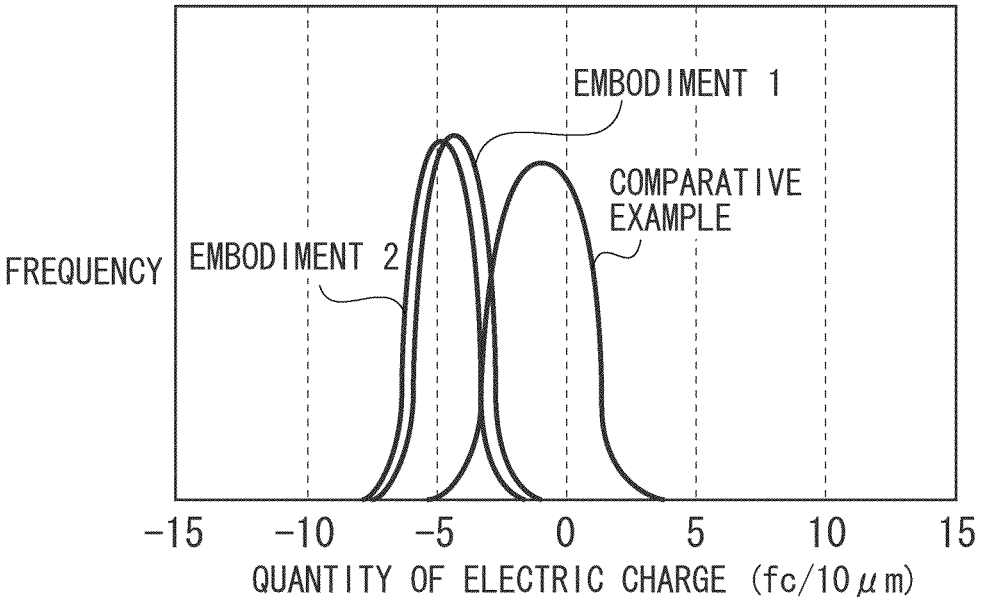
FIG. 13 is a diagram illustrating an example according to the fourth embodiment of the present invention.

The specific charge amount distributions of toner on the developing sleeve 16 in these examples and the comparative example are measured by the above-mentioned E-SPART analyzer manufactured by Hosokawa Micron Corp. The result is illustrated in FIG. 13. The evaluation result of the sleeve ghost and the durable density is shown in Table 4.

TABLE 4

| Item | Sleeve ghost Initial/10K/25K | Durable density/Uniformity Initial | 5K | 10K | 15K | 20K | 25K |
|---|---|---|---|---|---|---|---|
| Example 4-1 | A/A/B | 1.5/ 0.01 | 1.5/ 0.01 | 1.5/ 0.01 | 1.5/ 0.01 | 1.5/ 0.01 | 1.5/ 0.01 |
| Example 4-2 | A/A/A | 1.5/ 0.01 | 1.5/ 0.01 | 1.5/ 0.01 | 1.5/ 0.01 | 1.5/ 0.01 | 1.5/ 0.01 |
| Example 1-1 | A/A/B | 1.5/ 0.01 | 1.5/ 0.01 | 1.5/ 0.01 | 1.5/ 0.01 | 1.4/ 0.01 | 1.4/ 0.02 |
| Comparative example | D/D/D | 1.5/ 0.01 | 1.3/ 0.2 | 1.2/ 0.4 | 1.0/ 0.4 | 0.8/ 0.4 | 0.5/ 0.4 |

As seen from Table 4, the examples 4-1 and 4-2 of the present embodiment show good results in the sleeve ghost from the Initial to 25K of the endurance test, and also show good results in the durable density stability. When compared with the example 1-1, also, a good result is obtained in the durable density stability and the uniformity. In the example 4-2, a very good result is obtained in the sleeve ghost, the durable density stability, and the uniformity.

Regarding the rubber hardness, the effect of the present embodiment can be observed not only in the examples of the present embodiment, but also in a range up to hardness of 30 degree in JIS K-6301.

In the present embodiment, when the hardness is lower than 5 in SRIS 0101 hardness (Asker C hardness), the effect decreases due to deterioration in durability.

Therefore, the specific charge amount distribution of the toner can be further improved by a configuration including a conductive elastic layer having hardness of 5 or more in SRIS 0101 hardness (Asker C hardness) and hardness of 30 or less in hardness measured according to JIS K-6301.

It is difficult to measure the lower limit value of the hardness of conductive elastic layer by using hardness of JIS. Therefore, in the present embodiment, the lower limit value of the hardness is measured by Asker C hardness and the upper limit value of the hardness is measured according to JIS K-6301.

In the description of the present embodiment, an experiment is performed using a non-contact developing apparatus. However, when the present embodiment is applied to a contact developing apparatus, the same effect is obtained.

Figure 14:
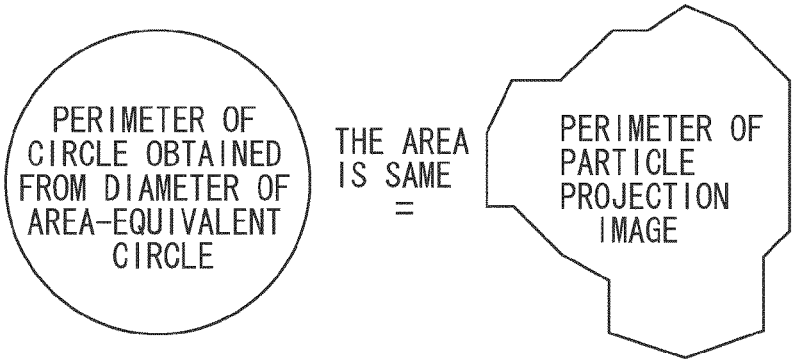
FIG. 14 is a diagram illustrating an example according to a fifth embodiment of the present invention.

A fifth embodiment of the present invention is characterized by using a toner having a degree of circularity C of 1.00 to 0.970 measured by FPIA-3000 manufactured by Sysmex Corporation and including 5 to 30% by weight of a low softening point material in the embodiments described above. On the other hand, in the first to fourth embodiments, a toner having a degree of circularity of 0.96 is used. The degree of circularity C is obtained by a method illustrated in FIG. 14. The specific method will be described below.

<How to Obtain the Degree of Circularity>

A measurement principle of the flow particle image analyzer "FPIA-3000" (manufactured by Sysmex Corporation) is to capture an image of flowing particles as a still image and analyze the still image. A sample added to a sample chamber is transferred to a flat sheath flow cell with a sample sucking syringe. The sample transferred to the flat sheath flow cell is sandwiched between sheath liquids to form a flat flow. The sample passing through the inside of the flat sheath flow cell is irradiated with stroboscopic light at an interval of 1/60 second, and the still image of the flowing particles is captured. The still image is captured in focus because the flow of the particles is flat. The still image is captured with a charge-coupled device (CCD) camera, and the still image is subjected to image processing at an image processing resolution of 512×512 pixels (0.37 μm by 0.37 μm per pixel) to extract the contour of each particle image in the still image, and a projected area S, a perimeter L, and the like are measured. A particle image refers to the image of a particle.

Next, by using the area S and the perimeter L, a circle-equivalent diameter and a degree of circularity are obtained. The circle-equivalent diameter is defined as a diameter of a circle having the same area as that of the projected area of a particle image. The degree of circularity C is defined as a value obtained by dividing the perimeter of a circle obtained from the circle-equivalent diameter by the perimeter of a particle projected image, and is calculated from the following equation.

The degree of circularity $C=(2\times(\pi\times S)^{1/2})/L$

When a particle image is of a complete round shape, the degree of circularity becomes 1. With an increase in a perimeter unevenness degree of the particle image, the degree of circularity decreases. After the degrees of circularity of the respective particles have been calculated, a range of the degree of circularity of 0.200 to 1.000 is divided into 800 sections, and an average value of the obtained degrees of circularity is calculated, and the average value is defined as an average degree of circularity.

<How to Obtain a Particle Size>

A weight average particle size (D4) and a number average particle size (D1) of the toner are calculated as described below. As the measurement apparatus, a precision particle size distribution measurement apparatus based on a pore electrical resistance method provided with a 100 μm aperture tube, the "Coulter Counter Multisizer 3" (registered trademark, manufactured by Beckman Coulter, Inc.) is used. The setting of the measurement conditions and analysis of the measurement data are carried out using the dedicated software included in the apparatus, "Beckman Coulter Multisizer 3 Version 3.51" (manufactured by Beckman Coulter, Inc.). Measurement is performed with 25,000 effective measurement channels.

As the electrolyte solution to be used in the measurement, a solution prepared by dissolving guaranteed reagent grade sodium chloride in deionized water to have a concentration of about 1 mass %, for example, an "ISOTON II" (manufactured by Beckman Coulter, Inc.) can be used.

The dedicated software is set in the following manner prior to carrying out measurement and analysis.

In the "change standard operation method (SOM)" screen of the dedicated software, the total count number of control modes is set to 50,000 particles, the number of times of measurement is set to 1, and a value obtained by using "standard particles 10.0 μm" (manufactured by Beckman Coulter, Inc.) is set as a Kd value. A threshold and a noise level are automatically set by pressing a "threshold/noise level measurement button". In addition, the current is set to 1,600 μA, gain is set to 2, the electrolyte solution is set to ISOTON II, and a check mark is placed in "flush aperture tube after measurement" check box.

In the "setting for conversion from pulse to particle size" screen of the dedicated software, a bin interval is set to logarithmic particle size, the number of particle size bins is set to 256, and the particle size range is set to the range of 2 μm to 60 μm.

The specific measurement method is as follows.

(1) About 200 ml of the electrolyte solution is charged into a 250 ml round-bottom glass beaker designed for the Multisizer 3. The beaker is set in a sample stand, and the electrolyte solution in the beaker is stirred with a stirring rod at 24 rotations/sec in a counterclockwise direction. Then, dirt and air bubbles in the aperture tube are removed by the "aperture flush" function of the dedicated software.

(2) About 30 ml of the electrolyte solution is charged into a 100 ml flat-bottom glass beaker. Then, the beaker is charged with, as a dispersant, about 0.3 ml of a diluted solution prepared by diluting "Contaminon N" (a 10 mass-% aqueous solution of a neutral detergent for washing a precision measuring device, containing a nonionic surfactant, a cationic surfactant, and an organic builder, and having a pH of 7, which is manufactured by Wako Pure Chemical Industries, Ltd.) with deionized water by a factor of about 3 in terms of mass.

(3) About 3.3 liters of deionized water is charged into the water tank of an ultrasonic disperser "Ultrasonic Dispersion System Tetora 150" (manufactured by Nikkaki Bios, co. ltd.) in which two oscillators having an oscillating frequency of 50 kHz are installed to be out of phase by 180°, and which has an electrical output of 120 W. About 2 ml of the Contaminon N is added into the water tank.

(4) The beaker in the above section (2) is set in the beaker fixing hole of the ultrasonic disperser, and the ultrasonic disperser is operated. Then, the height position of the beaker is adjusted so that the liquid level of the electrolyte solution in the beaker can resonate to the fullest extent possible.

(5) About 10 mg of the toner is gradually charged into and dispersed in the electrolyte solution in the beaker from the above section (4) while irradiating the electrolyte solution with ultrasonic waves. Then, the ultrasonic dispersion treatment is continued for additional 60 seconds. During the ultrasonic dispersion, the temperature of the water in the water tank is appropriately adjusted to be in the range of 10 to 40° C.

(6) The electrolyte solution from the above section (5), in which the toner has been dispersed, is added dropwise with a pipette into the round-bottom beaker from the above section (1) placed in the sample stand. Then, the measurement concentration is adjusted to about 5%. Measurement is performed until the 50,000 particles are measured.

(7) The measurement data is analyzed with the dedicated software included in the apparatus, and the weight average particle size (D4) and the number average particle size (D1) are calculated. The "average size" on the "analysis/volume statistics (arithmetic average)" screen when the dedicated software is set to graph/vol % is the weight average particle size (D4), and the "average size" on the "analysis/volume statistics (arithmetic average)" screen when the dedicated software is set to graph/number % is the number average particle size (D1). The weight average particle size (D4) is used as a toner particle diameter of the present invention.

In the description of the present embodiment, the developing sleeve 16 will be described using the example 2 of the fourth embodiment.

Figure 15:
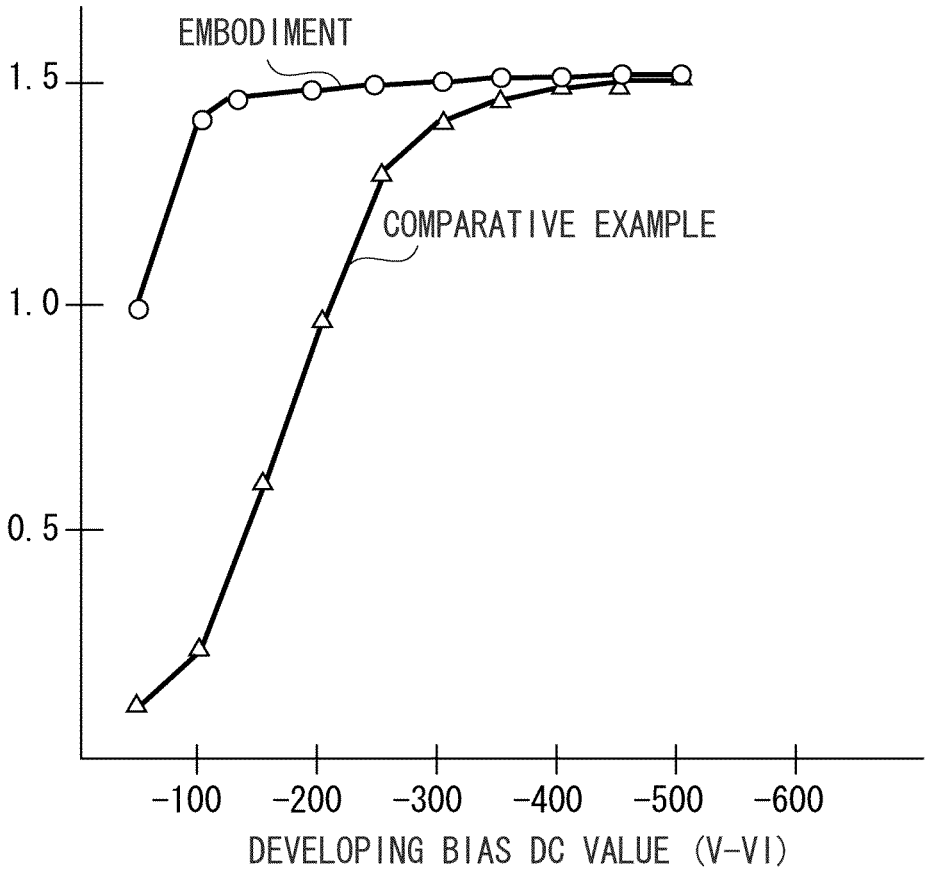
FIG. 15 is a diagram illustrating an example according to the fifth embodiment of the present invention.

FIG. 15 is a diagram for illustrating the effect of the present embodiment. In FIG. 15, a toner having a degree of circularity of 0.970 is used.

When the degree of circularity is 0.970 or more, even when a developing contrast value (V-V1) is as low as 100 V, the density is in an approximately flat area, and a significant improvement of developing efficiency is observed.

In the same manner as in the first to fourth embodiments, the sleeve ghost and the durable density are evaluated, and further blushing and residual toner densities after the development are measured. The result is shown in Table 5. Both the blushing and residual toner densities are evaluated by using the above-mentioned Macbeth reflection density meter (RD-918 manufactured by Macbeth Co.).

TABLE 5

| Item | Sleeve ghost Initial/10K/25K | Durable density/Blushing density/Uniformity Initial | 5K | 10K | 15K | 20K | 25K |
|---|---|---|---|---|---|---|---|
| Example 5 | A/A/B | 1.5/ 0.1 0.1 | 1.5/ 0.1 0.1 | 1.5/ 0.1 0.1 | 1.5/ 0.1 0.1 | 1.5/ 0.1 0.1 | 1.5/ 0.1 0.1 |
| Example 4-2 | A/A/A | 1.5/ 0.1 0.1 | 1.5/ 0.15 0.15 | 1.5/ 0.15 0.15 | 1.5/ 0.15 0.15 | 1.5/ 0.15 0.15 | 1.5/ 0.15 0.2 |
| Comparative example | D/D/D | 1.5/ 0.1 0.1 | 1.3/ 0.2 0.1 | 1.2/ 0.4 0.2 | 1.0/ 0.4 0.2 | 0.8/ 0.4 0.2 | 0.5/ 0.4 0.3 |

The above result indicates that, when the degree of circularity of the toner is 0.97, the residual toner decreases.

In the present embodiment, an example is shown in which the toner having a degree of circularity of 0.970 is applied to a non-contact developing apparatus. In the same way, when the toner is applied to a contact developing apparatus, the reduction effects of blushing and residual toner are achieved.

A sixth embodiment of the present invention includes a long print head in which an exposure unit arranges a plurality of light emitting sections along one direction. Further, the present embodiment is a cleanerless image forming apparatus that does not have a dedicated cleaning unit for the image bearing member and collects residual toner in the developing apparatus at the same time as performing developing operation.

In the present embodiment, a negatively charged toner is used, the image bearing member 1 includes the charging device 2, and the exposure device 3 uses an LED print head 3 in which the light emitting sections having a space density of 600 dpi and a wavelength of 780 nm are arranged in one direction. The developing apparatus 10 includes the developing sleeve 16 including an elastic material described in the above embodiments, and the developer regulating member 201 uses a metal blade made of phosphor bronze.

In the cleanerless apparatus, when the residual toner remains, the residual toner passes through the charging device 2 and reaches the exposure device 3 according to the rotation of the image bearing member. Then, the residual toner reaches the developing apparatus 10 and is collected onto the developer bearing member by an electric field.

In the cleanerless process, there is a toner adhesion problem in which the residual toner on the image bearing member flies and attaches to the exposure device 3. In particular, when a light-emitting diode (LED) is used as the exposure device 3, the exposure light amount is small, so the exposure device and the image bearing member are arranged close to each other. In this case, the toner easily attaches to the exposure device. When an LED is used as the exposure device, the distance of closest approach between the image bearing member and the LED is about 10 to 5000 μm.

Therefore, the inventors of the present invention considered sharpening the specific charge amount distribution and preventing occurrence of reversely charged toner (positively charged toner) or negatively charged but weakly charged toner (weakly charged toner). This is because such positively charged toner and weakly charged toner cannot be transferred in the transfer device and tend to be the residual toner.

Further, by increasing the transfer rate, it is possible to reduce the residual toner in a transfer section. As a method for increasing the transfer rate, there is a method for improving repellency of the image bearing member 1 with respect to the toner. As an indicator of the repellency, the contact angle of the image bearing member with respect to pure water is used.

When the residual toner is reduced, residual toner flying on the image bearing member is also reduced, so that it is also possible to reduce the toner adhesion to the exposure device.

Figure 16:
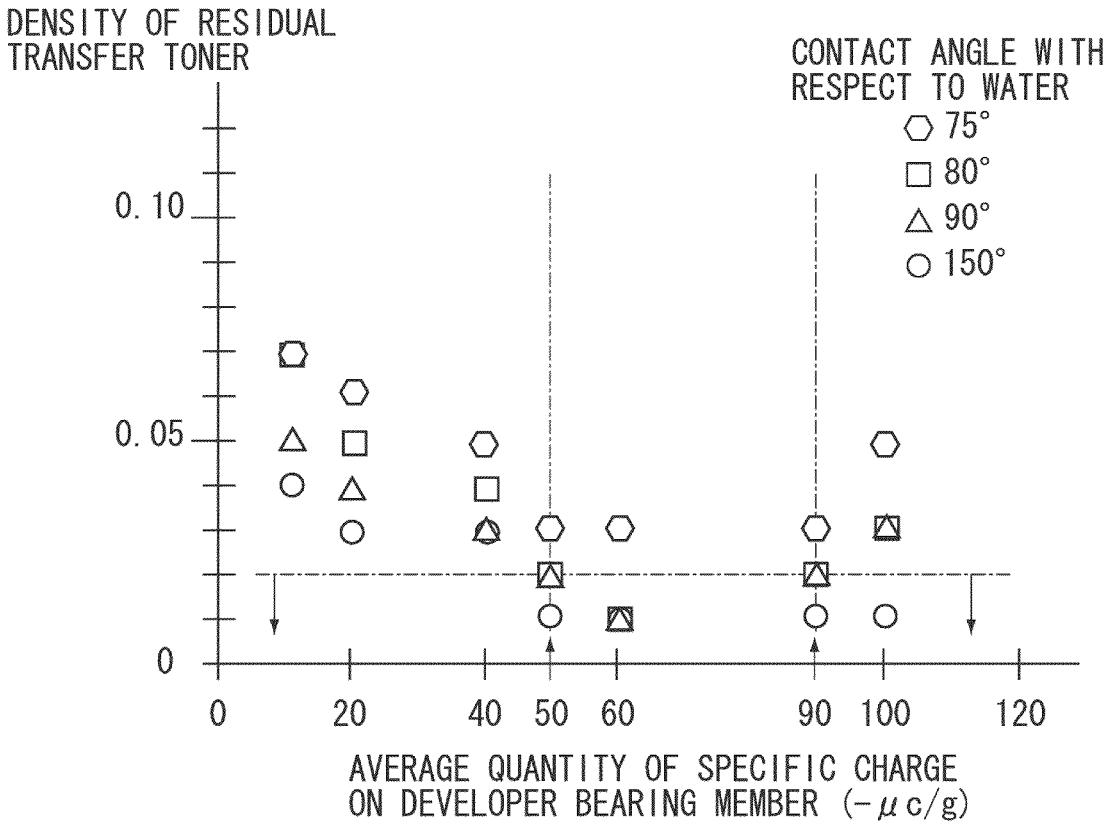
FIG. 16 is a diagram illustrating a sixth embodiment of the present invention.

FIG. 16 illustrates a relationship among the contact angle of the image bearing member 1 with respect to pure water, the specific charge amount of the developer after the development is performed on the image bearing member, and the density of untransferred toner.

Regarding the specific charge amount of the developer after the development is performed on the image bearing member, an absolute value of the specific charge amount on the image bearing member in an environment of temperature 27° C. and relative humidity 70% RH is measured by a Faraday gauge.

In a cleanerless system, when the density of the residual toner is 0.02 or less, it is confirmed that the cleanerless system reaches allowable level in practical use, so that a value of 0.02 or less is determined to be the allowable limit of the density of the residual toner, and the result as illustrated in FIG. 16 is derived.

Specifically, when the specific charge amount of the toner on the developer bearing member is 50 μC/g to 90 μC/g in absolute value, and the contact angle of the image bearing member 1 with respect to pure water is 90° to 150°, it is possible to satisfy the allowable limit.

When the absolute value of the specific charge amount of the toner is greater than 90 μC/g, the transfer rate tends to decrease, so that the specific charge amount can be 90 μC/g or less.

When occurrence of residual toner is suppressed by controlling the specific charge amount of the toner to a proper value, if the developing sleeve 16 including concave portions is used as described in the present embodiment, it is possible to sharpen the specific charge amount distribution of the toner. Therefore, it is possible to reduce toner having undesirable specific charge amount, and to achieve the effect of efficiently suppressing occurrence of the residual toner.

A part of modified examples other than the examples described in the above embodiments will be described.

It is possible to set the distance between an optical system of the exposure device 3 and an electrostatic latent image holding body to 0.01 mm or more and 1 mm or less. When the distance between the exposure device 3 and the image bearing member 1 is small, exposure can be performed even in an exposure device having a small light amount. On the other hand, there is a problem in which the toner attaches to the exposure device. However, when the developer bearing member and the developing apparatus according to the present embodiment are used, as described in the sixth embodiment, occurrence of optical pollution can be reduced. In particular, when the exposure device 3 is located below the image bearing member 1, the toner flying from the image bearing member falls by gravity to the exposure device 3, so that the toner easily attaches to the exposure device 3. However, by using the developing sleeve 16 as described in the above embodiments and sharpening the specific charge amount distribution of the toner, the residual toner is reduced. When the residual toner is reduced, toner flying everywhere is reduced, so that it is possible to suppress the toner adhesion to the exposure device 3.

When these toners are used, the amount of flying toner is reduced, and toner contamination does not occur in the exposure device 3.

A micro-lens can be used in an optical system of the exposure device. Also, a vertical cavity surface emitting laser (VCSEL) can be used in the optical system of the exposure device. By using the vertical cavity surface emitting laser, it is possible to manufacture the exposure device 3 having a higher allowable level of working distance (WD).

While the present invention has been described with reference to exemplary embodiments, it is to be understood that the invention is not limited to the disclosed exemplary embodiments. The scope of the following claims is to be accorded the broadest interpretation so as to encompass, for example, all substantially equivalent modifications, structures, and functions.

This application claims priority from Japanese Patent Application No. 2009-276832 filed Dec. 4, 2009, which is hereby incorporated by reference herein in its entirety.

What is claimed is:

1. A developer bearing member for carrying one-component developer for developing a latent image, the developer bearing member comprising:

a base body;

a surface layer provided above the base body; and a plurality of concave portions provided on the surface layer, the concave portions spaced apart from one another by and each surrounded by a top portion of the surface layer;

wherein a resistivity value of the surface layer is $10^2$ to $10^8$ Ω·cm, the number of the concave portions per unit area is 2250/$mm^2$ to 12254/$mm^2$, a major diameter of an opening of each concave portion is 8 to 20 μm, a depth of each concave portion is 2 to 5 μm, a dimensional tolerance of the major diameter is 0.5 μm or less, and a dimensional tolerance of the depth is 0.5 μm or less.

2. The developer bearing member according to claim 1, wherein at least one of the concave portions has a cornerless three-dimensional shape.

3. The developer bearing member according to claim 1, wherein a fine structure having a convex shape is provided inside at least one of the concave portions.

4. The developer bearing member according to claim 1, wherein a degree of hardness of the developer bearing member is 5 or more in terms of SRIS 0101 hardness and 30 or less in terms of hardness measured according to JIS K-6301.

5. A developing apparatus for developing a latent image, the developing apparatus comprising:

a developer bearing member including a base body and a surface layer on a surface of which a plurality of concave portions are provided and configured to carry one-component developer, the concave portions spaced apart from one another by and each surrounded by a top portion of the surface layer; and a developer regulating member configured to regulate an amount of developer carried on the developer bearing member;

wherein a resistivity value of the surface layer is $10^2$ Ω·cm to $10^8$ Ω·cm, the number of the concave portions per unit area is 2250/$mm^2$ to 12254/$mm^2$, a major diameter of an opening of each concave portion is 8 μm to 20 μm, a depth of each concave portion is 2 μm to 5 μm, a dimensional tolerance of the major diameter is 0.5 μm or less, and a dimensional tolerance of the depth is 0.5 μm or less.

6. The developing apparatus according to claim 5, wherein at least one of the concave portions has a cornerless three-dimensional shape.

7. The developing apparatus according to claim 5, wherein a fine structure having a convex shape is provided inside at least one of the concave portions.

8. The developing apparatus according to claim 5, wherein a degree of hardness of the developer bearing member is 5 or more in terms of SRIS 0101 hardness and 30 or less in terms of hardness measured according to JIS K-6301.

9. The developing apparatus according to claim 5, wherein an average particle diameter of the one-component developer is 4 μm to 6 μm.

10. The developing apparatus according to claim 9, wherein a degree of circularity of the one-component developer is 1.00 to 0.970.

11. The developing apparatus according to claim 5, wherein at least one of the concave portions has a circular shape as seen from above.

12. The developer bearing member according to claim 1, wherein at least one of the concave portions has a circular shape as seen from above.

13. An image forming apparatus comprising:

an image bearing member on which to form a latent image;

an exposure device arranged so that a distance of closest approach to the image bearing member is 10 μm to 5000 μm and configured to form the latent image by exposing the image bearing member; and a developing apparatus configured to develop the latent image;

wherein the developing apparatus includes:

a developer bearing member including a base body and a surface layer on which a plurality of concave portions are provided and configured to carry one-component developer, the concave portions spaced apart from one another by and each surrounded by a top portion of the surface layer; and a developer regulating member configured to regulate an amount of developer carried on the developer bearing member;

wherein a resistivity value of the surface layer is $10^2$ Ω·cm to $10^8$ Ω·cm, the number of the concave portions per unit area is 2250/$mm^2$ to 12254/$mm^2$, a major diameter of an opening of each concave portion is 8 μm to 20 μm, a depth of each concave portion is 2 μm to 5 μm, a dimensional tolerance of the major diameter is 0.5 μm or less, and a dimensional tolerance of the depth is 0.5 μm or less.

14. The image forming apparatus according to claim 13, further comprising a transfer device configured to transfer an image of developer on the image bearing member to a receiver;

wherein the exposure device includes a plurality of light emitting sections arranged along a longitudinal direction of the image bearing member, the developing apparatus is configured to collect developer remaining on the image bearing member at the same time as developing the latent image, in an environment of temperature of 27° C. and humidity of 70% RH, an absolute value of an amount of electric charge of the developer when the image of developer is formed on the image bearing member is 50 μC/g to 90 μC/g, and a contact angle of the image bearing member with respect to pure water is 90° to 150°.

15. The image forming apparatus according to claim 13, wherein at least one of the concave portion portions has a cornerless three-dimensional shape.

16. The image forming apparatus according to claim 13, wherein a fine structure having a convex shape is provided inside at least one of the concave portions.

17. The image forming apparatus according to claim 13, wherein a degree of hardness of the developer bearing member is 5 or more in terms of SRIS 0101 hardness and 30 or less in terms of hardness measured according to JIS K-6301.

18. The image forming apparatus according to claim 13, wherein an average particle diameter of the one-component developer is 4 μm to 6 μm.

19. The image forming apparatus according to claim 13, wherein a degree of circularity of the one-component developer is 1.00 to 0.970.

20. The image forming apparatus according to claim 13, wherein at least one of the concave portions has a circular shape as seen from above.

* * * * *